US008085225B2

(12) United States Patent
Kohno et al.

(10) Patent No.: US 8,085,225 B2
(45) Date of Patent: Dec. 27, 2011

(54) IMAGE DISPLAY APPARATUS

(75) Inventors: Tohru Kohno, Kokubunji (JP); Mitsuhide Miyamoto, Kokubunji (JP); Hajime Akimoto, Kokubunji (JP)

(73) Assignee: Hitachi Displays, Ltd., Chiba (JP)

( * ) Notice: Subject to any disclaimer, the term of this patent is extended or adjusted under 35 U.S.C. 154(b) by 959 days.

(21) Appl. No.: 12/005,317

(22) Filed: Dec. 27, 2007

(65) Prior Publication Data

US 2008/0170011 A1 Jul. 17, 2008

(30) Foreign Application Priority Data

Jan. 12, 2007 (JP) ..... 2007-004666

(51) Int. Cl.
*G09G 3/30* (2006.01)

(52) U.S. Cl. ..... 345/76; 315/169.3

(58) Field of Classification Search ..... 345/76, 345/77, 82, 87; 315/169.3
See application file for complete search history.

(56) References Cited

FOREIGN PATENT DOCUMENTS

| | | |
|---|---|---|
| JP | 2003-005709 | 6/2001 |
| JP | 2003-122301 | 10/2001 |

OTHER PUBLICATIONS

R.M.A. Dawson et al., "Design of an Improved Pixel for a Polysilicon Active-Matrix Organic LED Display", SID 98 Digest, pp. 11-14.

*Primary Examiner* — Ricardo L Osorio
(74) *Attorney, Agent, or Firm* — Stites & Harbison PLLC; Juan Carlos A. Marquez, Esq.

(57) ABSTRACT

In organic EL display apparatuses, when the reset operating time required for compensating variations in the OLED drive TFT voltage threshold is too short then fluctuations in the threshold voltage Vth cannot be corrected and an accurate gray scale is impossible. A precharge voltage is supplied from the precharge TFT switch prior to the reset TFT switch and the light TFT switch resetting the Vth of the OLED driver TFT, in order to apply a specified voltage value to the gate voltage of the OLED driver TFT prior to reset. The voltage potential on the gate of the OLED driver TFT prior to reset is therefore no longer an undetermined voltage potential so variations in the gate voltage after reset are suppressed and variations in the gray scale are suppressed.

8 Claims, 36 Drawing Sheets

IMAGE DISPLAY APPARATUS

CLAIM OF PRIORITY

The present application claims priority from Japanese application JP 2007-004666 filed on Jan. 12, 2007, the content of which is hereby incorporated by reference into this application.

FIELD OF THE INVENTION

The present invention relates to an organic EL (electroluminescent) display apparatus and relates in particular to an organic EL display apparatus emitting no residual images and with few irregularities in the gray scale display among the pixels.

BACKGROUND OF THE INVENTION

The CRT was once the mainstream in display apparatuses of the related art. However the CRT has since been replaced by flat panel display apparatuses such as liquid crystal display apparatuses and plasma display apparatuses that are now practical and in increasing demand. Moreover, besides these apparatuses, advances are also being made in developing display apparatuses that utilize organic electro-luminescence (hereafter called organic light-emitting diode (OLED) devices), and field emission display apparatuses (FED display apparatuses) where electron sources utilizing field emissions are arrayed in a matrix and form an image from the light emitted by a fluorescent element at the anode.

Prominent characteristics of organic EL display apparatuses include the following: (1) unlike liquid crystal devices, organic EL display apparatuses emit their own light and so do not require a backlight to operate; (2) the voltage needed to emit light is less than 10 volts so power consumption can be kept low; (3) organic EL display apparatuses do not need the vacuum structure required in FED and plasma displays and so are therefore thin and lightweight; (4) organic EL display apparatuses have a short response time in the microsecond range as well as excellent motion image characteristics; and (5) their field of vision angle is a wide 170 degrees or more.

Organic EL apparatuses using thin film transistor (TFT) switching elements possess excellent image quality including contract but there are irregularities in the display characteristics on the gray scale due to irregularities or variations in individual TFT. One countermeasure in the related art for this problem is the technology shown in the examples in FIG. 9 through FIG. 23.

FIG. 19 is a schematic of a drive circuit for the pixel section in the first example of the related art. In FIG. 19, an OLED drive TFT3 from the power supply line 51, a lighting TFT switch 2, an organic EL light-emitting element (OLED element 1) are connected in series, and one end of the OLED element 1 is connected to reference (voltage) potential. Here, the reference potential is the voltage potential used as a reference for the display apparatus, and is broad term that includes ground potential. The drive circuit controls the OLED element 1 brightness to form the image by regulating the electrical current flowing in the OLED element 1. The lighting TFT switch 2 controls the flow or non-flow of current in the OLED element 1.

The OLED drive TFT3 controls light emission gray scale intensity from OLED element 1 according to the signal from the signal line 54. In other words, a storage capacitor 4 connected to the gate of the OLED drive TFT3 accumulates the signal from the signal line 54 and the gray scale is displayed by controlling the current flowing in OLED drive TFT3 according to the voltage potential in the storage capacitor 4. However, there are large variations in the threshold voltage Vth due to individual manufacturing irregularities in the OLED drive TFT3. In order to compensate for these threshold Vth irregularities, a reset TFT 5 switch is turned on, and current is made to flow for a short period in the OLED drive TFT 3. Turning the switch on and making current flow sets the gate voltage V10 on OLED drive TFT 3 to a value also including the threshold voltage Vth of OLED drive TFT3 so the OLED element emits light to faithfully reproduce the image signal.

FIG. 20 is a timing chart for driving the drive circuit in FIG. 19. As shown in the upper section of FIG. 2, this drive circuit is separated into a write period in the first half of a single frame and a light emission time in the latter half. The drive circuit writes the gray scale signal in each pixel during the write period. FIG. 20 shows the state where data is written at the write operation position in the scanning line sequence. The lower part of FIG. 20 shows the timing for writing on the pixels. In FIG. 20, the drive circuit first turns the reset TFT switch 5 on and then shorts V10 and V12 shown in FIG. 19. Current next flows in the OLED drive TFT3 when the lighting TFT switch 2 turns on. The time where the lighting TFT switch 2 and the reset TFT switch 5 simultaneously turn on is tc4 as shown in FIG. 20. If tc4 is sufficiently long, then the gate voltage V10 for OLED drive TFT3 converges on the values for the intersection point of the straight line of V10=V12 with the characteristic curve for drain voltage 12 and gate voltage V10 of LED drive TFT3. This state is shown in FIG. 21 through FIG. 23. The vertical axis in FIG. 21A shows the V10 value in FIG. 19, and the horizontal value is the time. The V12 values for the point in time that lighting TFT switch 2 turned on is undefined here since it depends on the display status of the prior frame. This V12 value in other words is seen as between a voltage of ground potential or higher to ground potential. The reset TFT switch 5 is turned on at this time so V12 and V10 are the same value. If tc4 is sufficiently long here, then as described above, the gate voltage 10 for OLED drive TFT3 converges on the values for the intersection point of the straight line of V10=V12 with the characteristic curve for drain voltage 12 and gate voltage V10 of LED drive TFT3, or in other words converges on Vres10. This operation is the same in FIG. 21B and FIG. 21C. The voltage threshold Vth for OLED drive TFT3 may differ among FIG. 21A, FIG. 21B and FIG. 21C.

FIG. 22 shows how the voltage potential for V10 in FIG. 19 is set for OLED drive TFT3 possessing different characteristics. In FIG. 19, when the lighting TFT switch 2 is on, then the OLED drive TFT3 and OLED element 1 may together form an inverter. The curve in FIG. 22 shows characteristics of the drain voltage V12 and gate voltage V10 of OLED drive TFT3, and the straight line in FIG. 22 shows the V10 equals V12. The reset TFT switch 5 here shorts the gate and drain of OLED drive TFT3, which causes the gate of OLED drive TFT3 to be set to a voltage decided by the intersection of the straight line of V10=V12 with the characteristic curve for OLED drive TFT3. Characteristic curves for the three OLED drive TFT3 of different threshold voltages Vth are drawn in FIG. 22. As shown in FIG. 22, the gate voltage for OLED drive TFT3 is set to a threshold voltage Vth that includes the different threshold voltage Vth of each OLED drive TFT.

The operation point Vres10 for the characteristic MAX in FIG. 22 corresponds to the Vres10 in FIG. 21A. The operation point Vres11 for characteristic TYP in FIG. 22 corresponds to Vres11 in FIG. 21B. The operation point Vres12 for the characteristic MIN in FIG. 22 corresponds to Vres12 in FIG.

21A. These operation points are reflected in the Vth of OLED drive TFT13. Based on these operation points, the image signal from line 54 is written in the storage capacitor 4. FIG. 23 shows the relation between the value V12 roughly equal to the positive voltage for the OLED element and signal voltage V11 shown in FIG. 19. As shown in FIG. 23, even if there are variations in the OLED drive TFT there is almost no effect on the signal voltage V11 and drive voltage for the OLED element or in other words, the light emission characteristics.

The second example of the related art for compensating for variations in the gray scale display is described in FIG. 27 through FIG. 34. FIG. 27 is a drive circuit for driving one pixel. In FIG. 27, the OLED drive TFT3, the lighting TFT switch 2 and the OLED element 1 are connected in series from the power supply line 51. The lighting TFT switch 2 controls emission (or no emission) in the OLED element 1. The OLED drive TFT 3 shows the gray scale display at the established voltage based on the charge accumulated in the first storage capacitor 41. In this case also, the reset TFT switch 5 is utilized to suppress variation in the light emission characteristics of OLED element 1 due to variations in the (threshold voltage) Vth of the OLED drive TFT3.

FIG. 28 is a drawing for describing the operation of the drive circuit in FIG. 27. The TFT used in FIG. 27 is the P-type so the TFT turns on when a negative signal arrives. In the comparative example 2, when a gray scale voltage is written in each pixel in a signal frame period, that gray scale voltage is maintained to make the OLED element 1 emit light. In the initial state in FIG. 28, the lighting TFT switch 2 is on. This state turns on the select switch 6. Data from the signal line 54 is in this way inputted to the pixels. Next, when the reset TFT switch 5 turns on, the drain voltage V15 for OLED drive TFT3, and the gate voltage V13 for OLED drive TFT3 are shorted together. The lighting TFT switch 2 next turns off and the V13 voltage shown in FIG. 27 converges on a lower voltage value of Vth for OLED drive TFT3 than the power supply voltage. The reset TFT switch 5 then turns off and when the signal voltage from signal line 54 is written, charges reflecting the signal voltage are accumulated in the second storage capacitor 42 and the first storage capacitor 41 regardless of the Vth of LED drive voltage TFT3, and an accurate gray scale can be displayed.

However, the initial value of the V13 voltage potential shown in FIG. 27 is dependent on the display state of the previous frame so the value is undefined. Namely, this value may appear as at voltage between ground potential and the supply voltage or higher. After the reset switch is turned on, the above operation converges V13 at a value where the Vth of the OLED drive TFT3 is subtracted from the supply voltage, in the period of time tc5 until the lighting switch TFT 2 turns off. This state is shown in FIGS. 29A to 29C. As shown in FIG. 29A, the value for V13 in FIG. 27 converges on Vres13 when the Vth is small. In FIG. 29B the value for V13 converges on Vres14, when the Vth is at reference potential. In FIG. 29C, the V13 converges on Vres15 when the Vth is large.

FIG. 30 shows the OLED drive TFT3 input/output characteristics. In FIG. 30 the vertical axis shows the drain voltage V15 for OLED drive TFT3 forming the anode for OLED element 1 and the horizontal axis shows the gate voltage V13 for OLED drive TFT3 during pixel lighting. If there are variations among the OLED drive TFT3 characteristics, then the gate voltage for OLED drive TFT3 is converged respectively on the Vres13, Vres14, and Vres15 according to the OLED drive TFT3 characteristics. The signal voltage overlaps these converged voltages so light emission on the gray scale for OLED element 1 accurately reflects this signal voltage. This state is shown in FIG. 31. In FIG. 31, the vertical axis shows the drain voltage V15 for the OLED drive TFT3 forming the anode of the lighting OLED element 1, while the horizontal axis is the signal input voltage V14. As shown in FIG. 31, the variations in light emission intensity in OLED element 1 are small even if there are variations in the threshold voltage Vth of OLED drive TFT3.

The related art described above are disclosed in "JP-A No. 2003-5709", "JP-A No. 2003-122301", and "Digest of Technical Papers, SID98, pp. 11-14".

SUMMARY OF THE INVENTION

All of the above examples of technology of the related art cancel out variations in the OLED drive TFT3 threshold voltage Vth by utilizing the reset TFT reset switch 5. In order to converge the voltage V10 in FIG. 19 to a specified voltage or to converge the voltage V13 in FIG. 17 to a value where Vth is subtracted from the supply voltage, current must be made to flow for a specified time in OLED drive TFT3. Also, the initial values for V10 in FIG. 19 or V13 in FIG. 27 are undefined since they depend on the previous frame display state. In other words, these values might be any value from the supply voltage or higher to ground potential. Therefore if the time is too short, a phenomenon occurs where the OLED drive TFT 3 gate voltage potential cannot converge to a fixed value. Cases where the time is inadequate, are when the current flow required for converging is too small while operated at low power supply conditions, or when the write time allotted to each pixel has decreased under high accuracy conditions.

The problem points stated above are described using the related art 1 in FIG. 24 through FIG. 26. FIG. 24A shows the case where the initial voltage potential for gate voltage V10 of OLED drive TFT in FIG. 19 is the power supply voltage, and the time tc4 for converging is not sufficient. In this case, V10 is the value Vmax4 and does not converge on the Vres value. FIG. 24B shows the case where the initial voltage potential for the gate voltage V10 of the OLED drive TFT is basically closest to Vres11, however in this case the time tc4 needed for converging is inadequate. FIG. 24C shows the case where the initial voltage potential for gate voltage V10 of OLED drive TFT in FIG. 19 is ground potential, and in this case the time tc4 needed for converging is insufficient. In this case, V10 becomes the value Vmin4 without converging on the value for Vres12.

FIG. 25 shows this operation. Due to the TFT characteristics, there are variations in the operation of the inverter made up of the OLED drive TFT3 and the lighting TFT switch 2. If the tc4 period is long enough, then the operation point is the point where the lines V10=V12 and each inverter characteristics intersect. Namely, the operation point is set at Vres12, Vres11, and Vres10. However if the tc4 time is not sufficiently long enough, then the operation point is set for Vmin4, Vmax4 due to TFT variations. When set in that way, the TFT variations cannot be fully cancelled out and as shown in FIG. 26, due to Vth variations in the OLED drive TFT3, the light emission intensity differs even at the same signal voltage and during display of moving images the light emission does not appear uniform. If the light emission gray scale is maintained, then the operation point will then set in Vres12, Vres11 and Vres10 after a number of frames but will differ from the desired light emission intensity for display and so will appear as a residual image. The V11 and V12 shown in FIG. 26 are the drain voltage potential for OLED drive TFT3 and the voltage potential for each signal line 54 as shown in FIG. 19.

The above problem points are described for the related art 2 in FIG. 32 through FIG. 34. In the pixel circuit in FIG. 27, the gate voltage V13 for the OLED drive TFT 3 is undefined prior to turning on the reset TFT switch 5 and the voltage potential might seen as either supply voltage potential or ground potential depending on the image signal level. FIG. 32A shows the case where the initial voltage potential is the (power) supply voltage. The time for tc5 shown in FIG. 28 is not long enough so the voltage potential V13 does not reach Vres13, and has become Vmax5. In FIG. 32B, the initial voltage for V13 is basically close to Vres14 but the time tc5 for convergence is sometimes not long enough. In FIG. 32C, the initial voltage potential for V13 of FIG. 27 is ground potential but the time tc5 for convergence is not long enough. In this case, V13 cannot converge to the Vres15 value and is the value Vmin5.

This operation is shown in FIG. 33. In FIG. 33, the relation between the gate voltage V13 and the drain voltage V15 is irregular due to variations in the OLED drive TFT3 characteristics, and causes variations in the operation points in the gate voltage of OLED drive TFT3. If the reset time tc5 shown in FIG. 28 is long enough, then the operation points will be set to Vres15, Vres14, and Vres13 according to the Vth variations in OLED drive TFT3 on the input/output operation points of each OLED drive TFT3. However if the convergence time tc5 is not long enough then each OLED drive TFT3 gate voltage will vary between Vmin5 or Vmax5 due to the operating characteristics of each inverter. The Vth for OLED drive TFT3 cannot be compensated at Vmin5 or Vmax5 so the light emitted from OLED element 1 will not sufficiently match the signal voltage. This state is shown in FIG. 34. FIG. 34 shows characteristics of the source voltage V15 of OLED drive TFT3 that drives the OLED element 1 per the signal voltage V14. As shown in FIG. 34, V15 varies due to variations in OLED drive TFT3 even for the same V14 so that variations or irregularities occur in the OLED element 1 light emission intensity.

This invention resolves the aforementioned problems, and by applying a pre-charge signal, set the initial voltage potential of the OLED drive TFT gate voltage to a fixed value prior to reset, so that the OLED drive TFT can be reset in a short time with no variations. A specific description of the structure is given as follows.

(1) An image display apparatus including a display unit formed from multiple pixels containing light-emitting elements, and signal lines for inputting image data signals to the pixel region, and a field effect transistor for driving the light-emitting elements based on image data signals inputted to the pixels via the signal lines; and characterized in that a reference voltage is applied to the source electrode of the field effect transistor; and a capacitor and a first switching unit for connecting the gate and drain of the field effect transistor are connected to the gate electrode; and a second switching unit for applying a specified external voltage is connected to the drain electrode.

(2) An image display apparatus including a display unit formed from multiple pixels containing light-emitting elements, and signal lines for inputting image data signals to the pixel region, and a field effect transistor for driving the light-emitting elements based on image data signals inputted to the pixels via the signal lines; and characterized in that a reference voltage is applied to the source electrode of the field effect transistor; and a first switching unit for connecting the gate and drain of the field effect transistor, and a second switching unit for applying a specified external voltage, and a capacitor are connected to the gate electrode.

(3) An image display apparatus including a display unit formed from multiple pixels containing light-emitting elements, and signal lines for inputting image data signals to the pixel region, and a field effect transistor for driving the light-emitting elements based on image data signals inputted to the pixels via the signal lines; and characterized in that a reference voltage is applied to the source electrode of the field effect transistor; and a capacitor, and a reset switch for connecting the gate and drain of the field effect transistor are connected to the gate electrode; and a third switching unit for regulating the supply of electrical current based on the image data signal for the light-emitting elements is connected to the drain electrode; and the light-emitting elements contain an anode and a cathode; and the third switching unit, and the second switching unit for applying a specified external voltage are connected to the anode.

(4) An image display unit including a display unit formed from multiple pixels containing light-emitting elements, and signal lines for inputting image data signals to the pixel region, and a field effect transistor for driving the light-emitting elements based on image data signals inputted to the pixels via the signal lines; and characterized in that a reference voltage is applied to the source electrode of the field effect transistor; and a capacitor, and a reset switch for connecting the gate and drain of the field effect transistor are connected to the gate electrode; and a third switching unit for regulating the supply of electrical current based on the image data signal for the light-emitting elements is connected to the drain electrode; and the light-emitting elements contain an anode and a cathode; and the third switching unit, and the second switching unit for applying a specified external voltage are connected to the cathode.

(5) An image display apparatus according to (1) characterized in that the second switching unit is connected to the signal line.

(6) An image display apparatus according to (1) characterized in that the light emitting unit is an organic EL element (OLED, Organic Light Emitting Diode).

(7) An image display apparatus according to (1) characterized in that the field effect transistor and the switching unit are formed on a transparent substrate utilizing a polycrystalline Si-TFT (Thin Film Transistor).

(8) An image display apparatus according to (1) including a structure for resetting a capacitor connected to the gate electrode of the field effect transistor by applying a specified external voltage by turning on a second switching unit to the drain electrode of the field effect transistor connected by a diode to turn on a first switching unit.

(9) An image display apparatus according to (2) characterized in that the second switching unit is connected to the signal line.

(10) An image display apparatus according to (2) characterized in that the light emitting unit is an organic EL element (OLED, Organic Light Emitting Diode).

(11) An image display apparatus according to (2) characterized in that the field effect transistor and the switching unit are formed on a transparent substrate utilizing a polycrystalline Si-TFT (Thin Film Transistor).

(12) An image display apparatus according to (2) including a structure for resetting a capacitor connected to the gate electrode of the field effect transistor by applying a specified external voltage by turning on a second switching unit.

(13) An image display apparatus according to (3) characterized in that the second switching unit is connected to the signal line.

(14) An image display apparatus according to (3) characterized in that the light emitting unit is an organic EL element (OLED, Organic Light Emitting Diode).

(15) An image display apparatus according to (3) characterized in that the field effect transistor and the switching unit are formed on a transparent substrate utilizing a polycrystalline Si-TFT (Thin Film Transistor).

(16) An image display apparatus according to (3) including a structure for resetting a capacitor connected to the gate electrode of the field effect transistor by applying a specified external voltage by turning on a second switching unit and a third switching unit to the drain electrode of the field effect transistor connected by a diode by turning on a first switching unit.

(17) An image display apparatus according to (4) characterized in that the second switching unit is connected to the signal line.

(18) An image display apparatus according to (4) characterized in that the light emitting unit is an organic EL element (OLED, Organic Light Emitting Diode).

(19) An image display apparatus according to (4) characterized in that the field effect transistor and the switching unit are formed on a transparent substrate utilizing a polycrystalline Si-TFT (Thin Film Transistor).

(20) An image display apparatus according to (4) including a structure for resetting a capacitor connected to the gate electrode of the field effect transistor by applying a specified external voltage by turning on a second switching unit and a third switching unit to the drain electrode of the field effect transistor connected by a diode by turning on a first switching unit.

This invention is capable of reducing effects on the gray scale due to variations in the Vth in OLED drive TFT even if the time for reset operation is not long enough, and capable of emitting uniform light that does not generate residual images even during display of moving images.

DETAILED DESCRIPTION OF THE PREFERRED EMBODIMENTS

This invention is described in detail according to the following embodiments.

First Embodiment

Figure 1A:
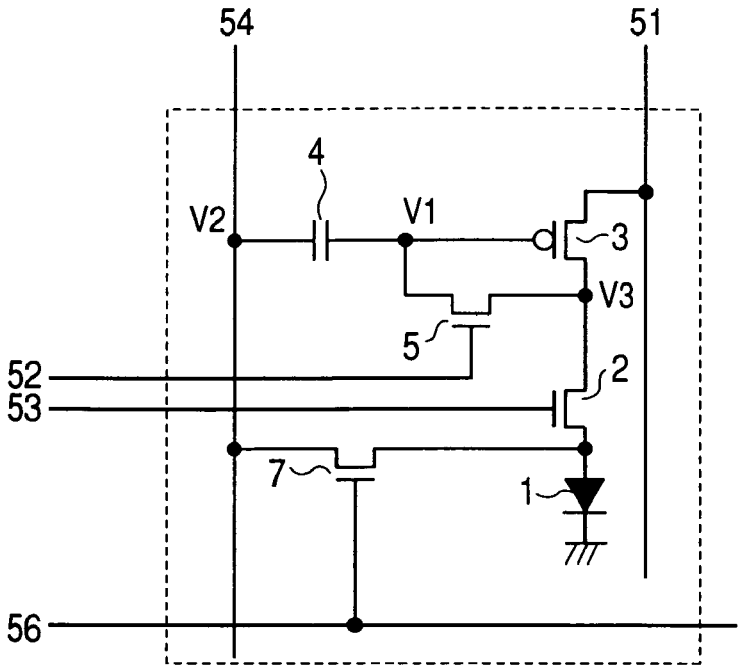
FIG. 1A is a first structure of the pixel drive circuit of the first embodiment.
Figure 1B:
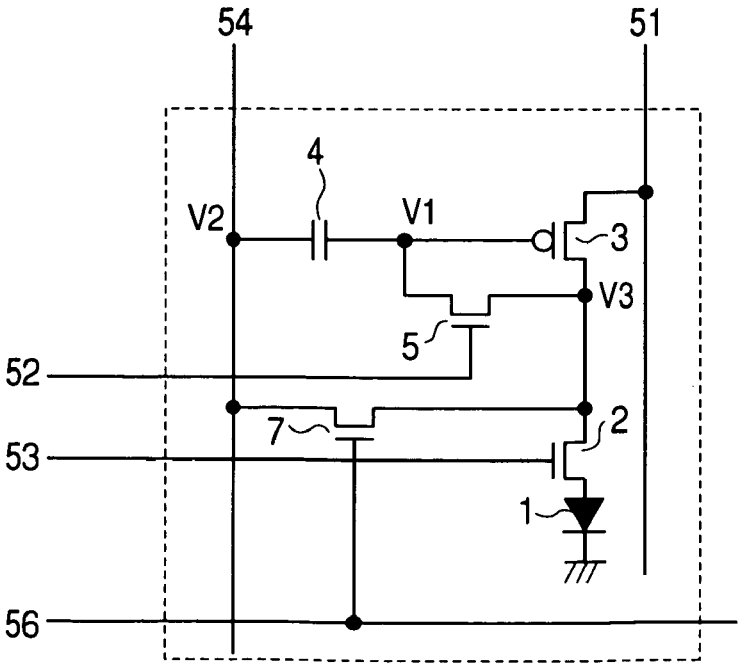
FIG. 1B is a second structure of the pixel drive circuit of the first embodiment.
Figure 1C:
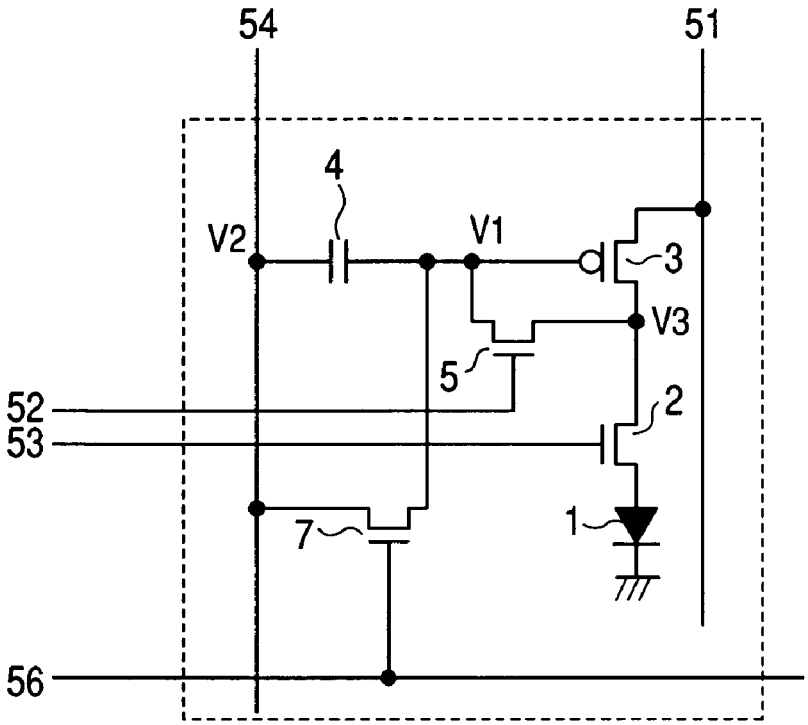
FIG. 1C is a third structure of the pixel drive circuit of the first embodiment.

FIGS. 1A, 1B, and 1C are circuit diagrams showing the pixel structure in this invention. The circuit diagrams in A through C of FIG. 1 are countermeasures to problems in the circuit in the first example of the related art of the related art. In FIGS. 1A to 1C, the OLED drive TFT 3, the lighting TFT switch 2, and the OLED element 1 are connected in series to the power supply line 51. A reset TFT switch 5 is also installed to improve the brightness scale characteristics affected by variations in the OLED drive TFT3 threshold voltage Vth. This reset TFT switch 5 is operated in order to compensate for variations in the Vth of OLED drive TFT3. This reset operation must simultaneously turn the reset TFT switch 5 and the lighting TFT switch 2 on and make current flow in the OLED drive TFT3. However the operation time and amount of current are limited. If there is enough time to turn the reset TFT switch 5 and the lighting TFT switch 2 on simultaneously, then the gate voltage for OLED drive TFT3 can converge on the voltage determined by the cross point of the characteristic curve of OLED drive TFT3 and the (straight) line for V1=V3. However due to the operating conditions a sufficient amount of electrical current or time cannot be obtained. On the other hand, the initial value prior to resetting the OLED TFT3 gate voltage depends on the prior frame's display state and is therefore undefined (not fixed). In other words, this value causes the voltage to vary between at least supply voltage and ground potential and so is set above or below the voltage where it should actually converge and variations also occur at that setting point.

In this embodiment, a pre-charge TFT switch 7 supplies a precharge voltage to the terminal of OLED element 1 when utilizing the circuit in FIG. 1A. In the circuit shown in FIG. 1B, the pre-charge switch 7 supplies a precharge voltage to the cross point of the reset TFT switch 5 and the lighting TFT switch 2. In the circuit shown in FIG. 1C, the pre-charge switch 7 supplies a precharge voltage to the gate 3 of the OLED drive TFT3. Applying this precharge voltage before reset, maintains the voltage potential on the lighting TFT switch 2 of the OLED inverter including OLED drive TFT3 and lighting TFT switch 2 at a fixed voltage. This precharge voltage also sets the gate voltage V1 of OLED drive TFT3 to a fixed value prior to reset. Variations (or irregularities) in the Vth can in this way be compensated regardless of the prior frame display state, even when the reset operation time is not long enough.

Figure 2:
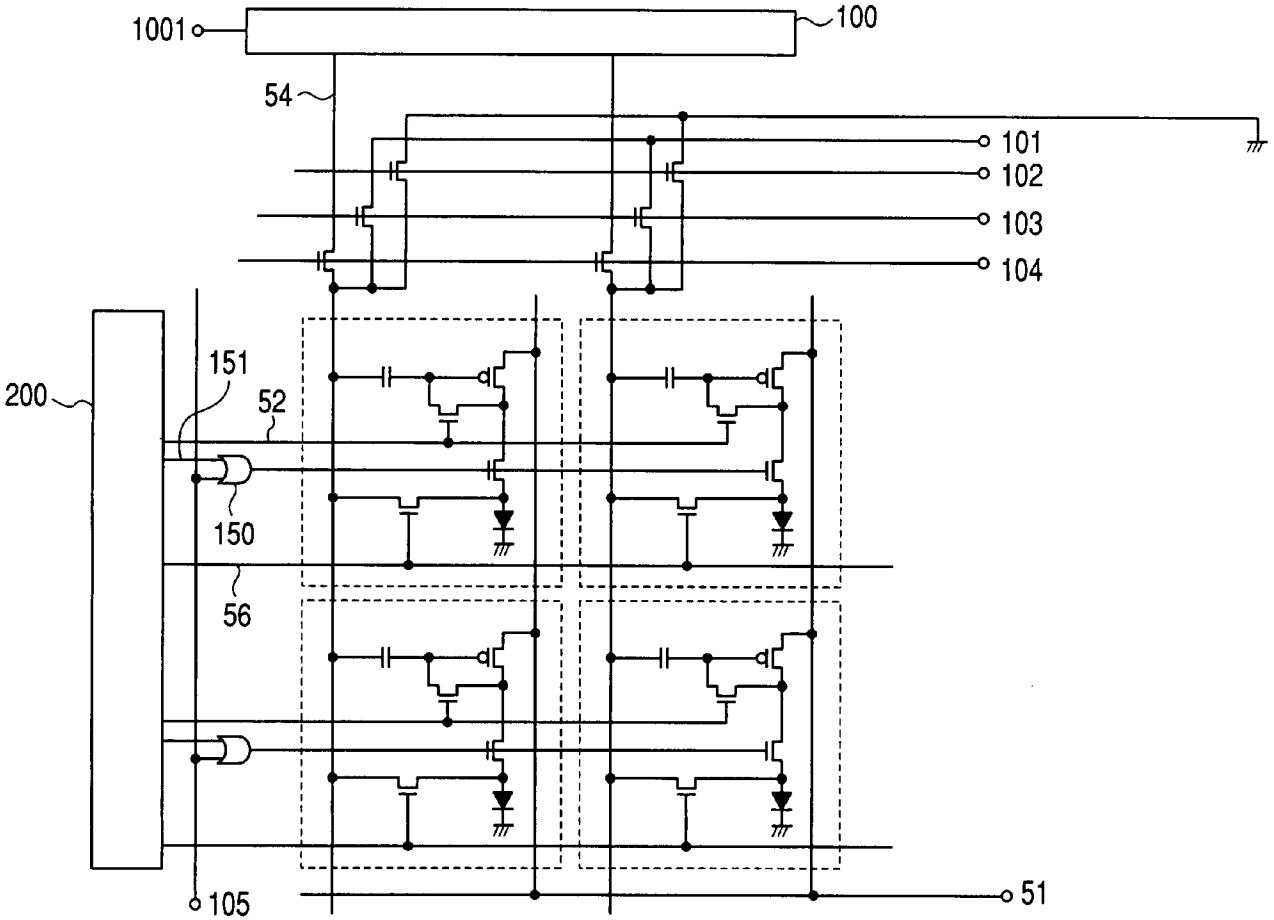
FIG. 2 is a drive circuit for the display apparatus of the first embodiment.

FIG. 2 is a circuit diagram showing the overall structure of the display apparatus. The actual screen is made up of many pixels but only four pixels are shown in FIG. 2. In FIG. 2, a gate drive circuit 200 is installed at the side of the screen. A reset line 52 and a scanning output line 151 extend from the gate drive circuit 200. The reset line 52 connects to the gate of the reset TFT switch 5, and the scanning output line 151 inputs signals to the lighting switch OR gate 150. A lighting control line 105 connects (inputs) to the lighting switch OR gate 150, and this lighting switch OR gate 150 outputs a signal to the gate of the lighting TFT switch 2 using either signal from the scanning output line 151 or from the lighting control line 105.

A signal drive circuit 100 is installed at the upper side of the screen. External image signals are supplied to this signal drive circuit via the signal input line 1001. A precharge supply line for supplying a ground potential as the precharge signal, a triangular wave input line 101, a precharge signal select line 102, a signal select switch control line 103, and a signal line select switch control line 104 extend between the signal drive circuit 100 and the screen. These outputs are applied at different times by the switching TFT to the signal line 54 extending from the signal drive circuit 100. One end of a storage capacitor 4 and the source of the precharge TFT switch 7 are connected to the signal line 54.

Figure 3A:
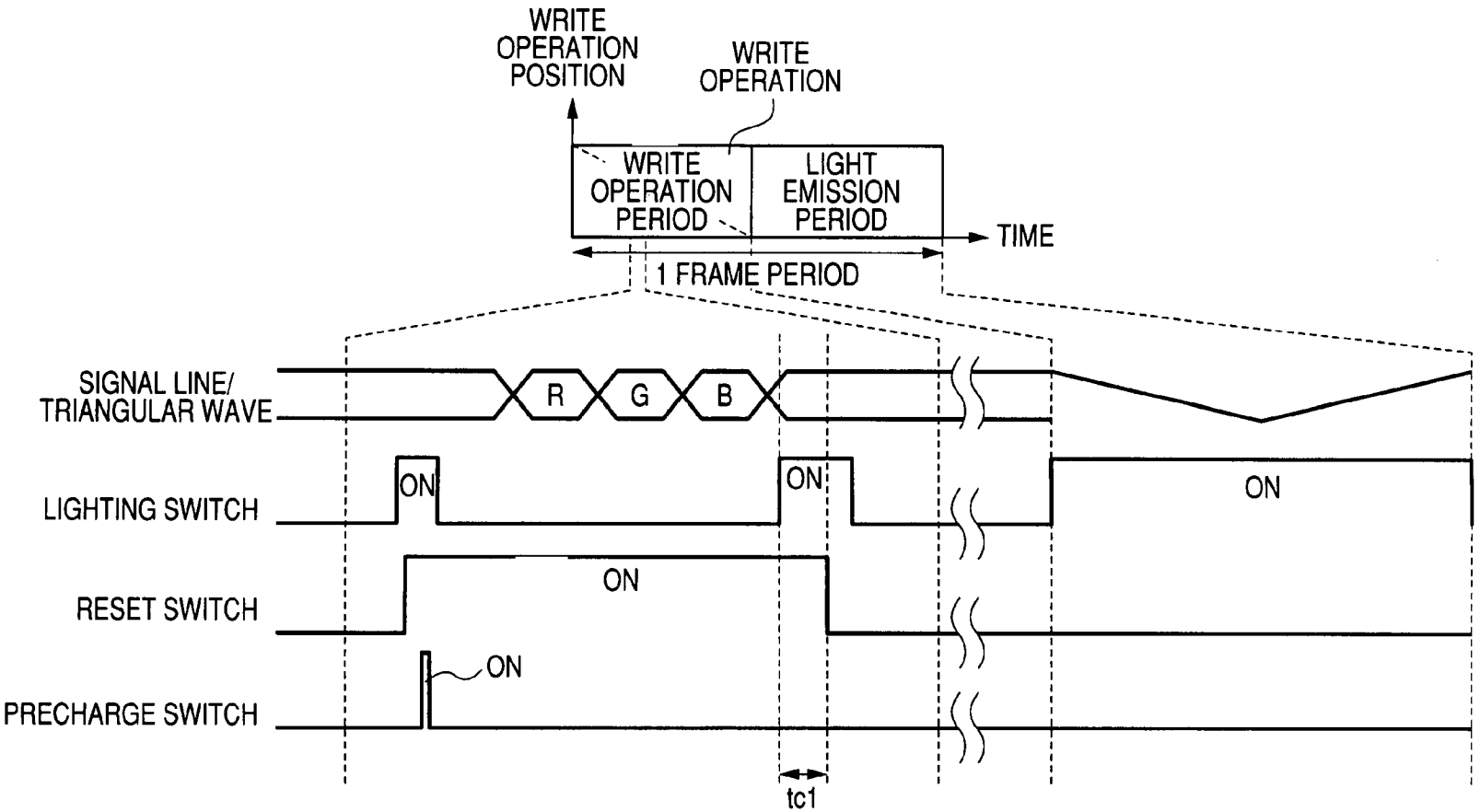
FIG. 3A is a timing chart for FIG. 1A.
Figure 3B:
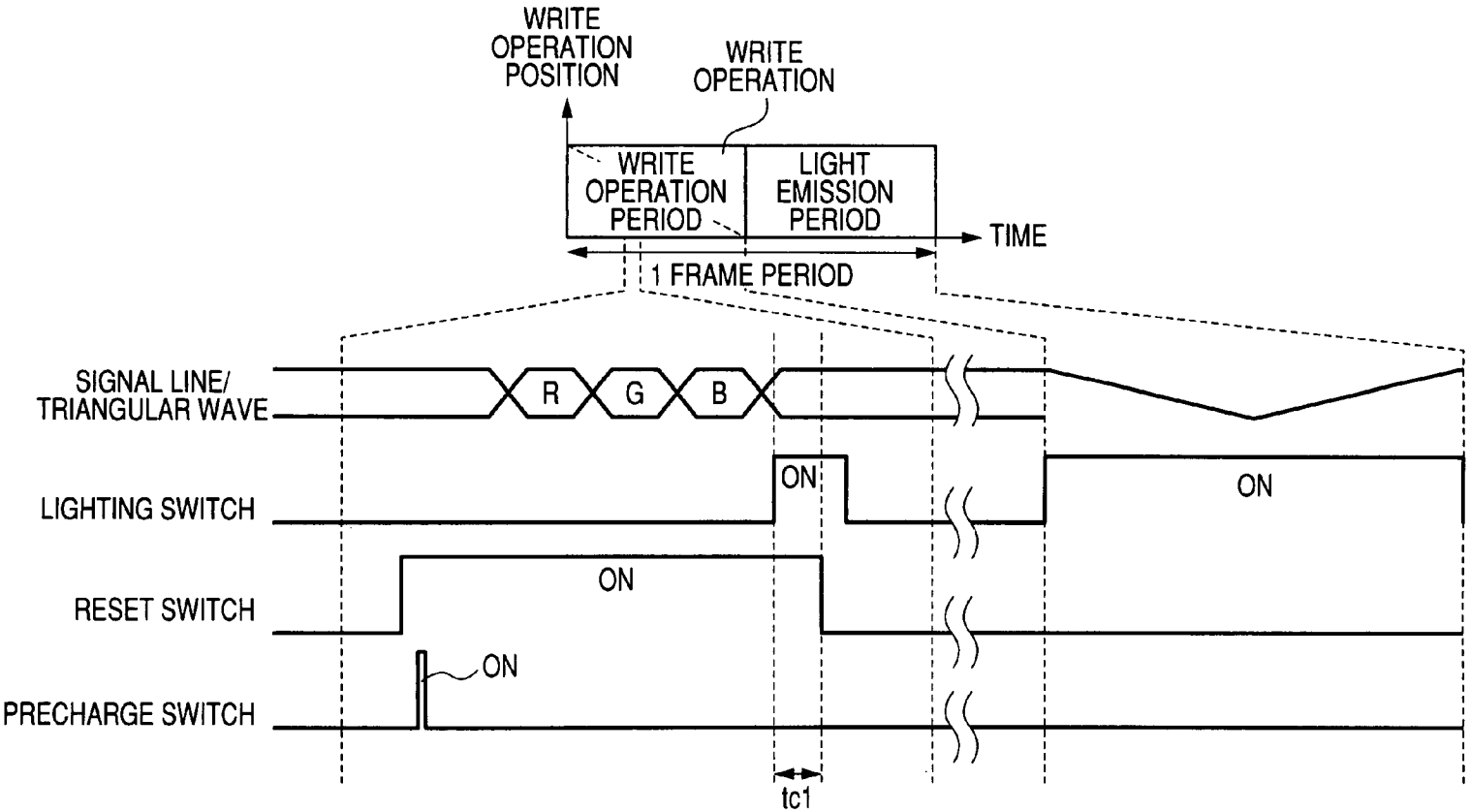
FIG. 3B is a timing chart for FIG. 1B.
Figure 3C:
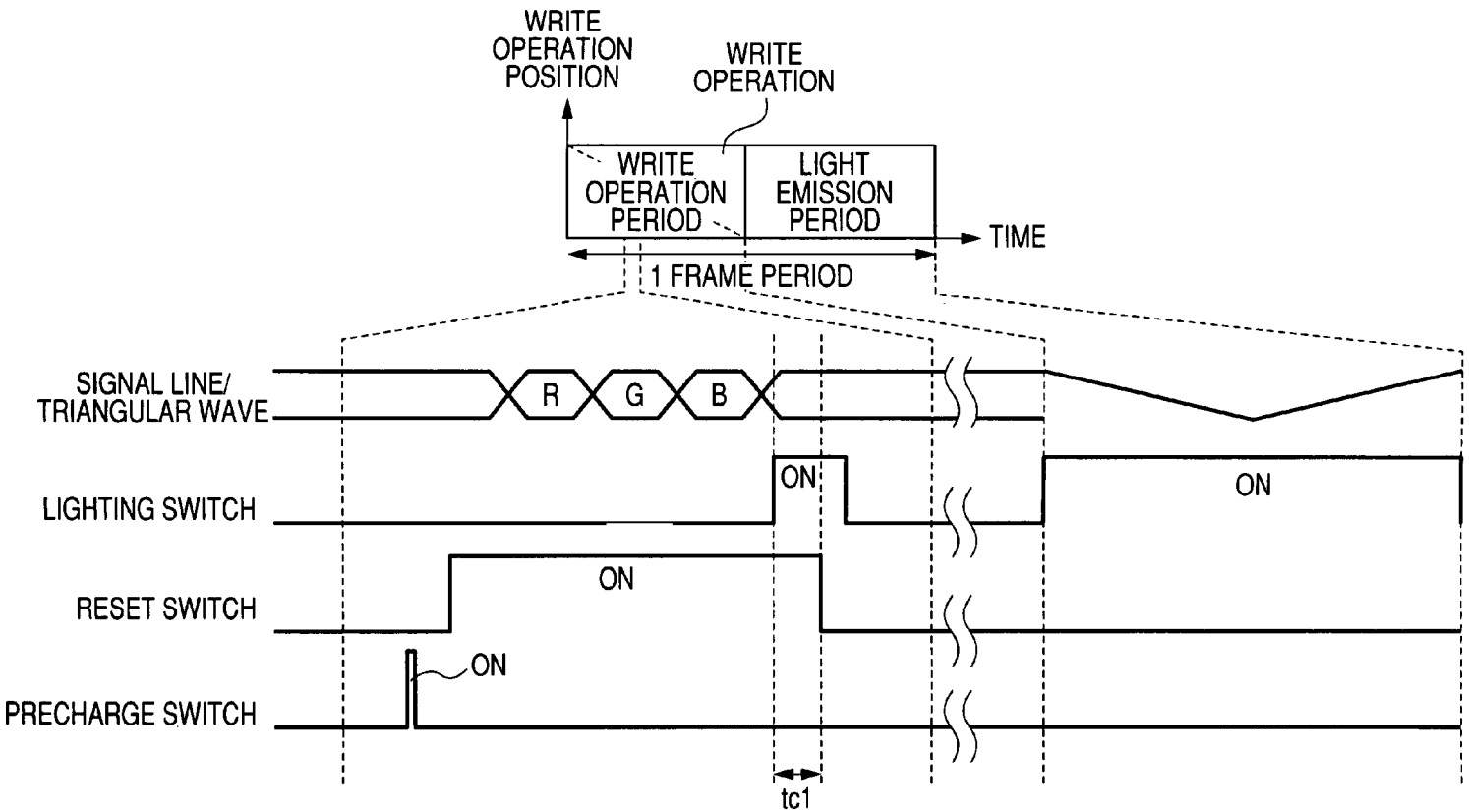
FIG. 3C is a timing chart for FIG. 1C.

FIG. 3A through FIG. 3C are timing charts showing the operation in FIGS. 1A through 1C and FIG. 2. In the circuit operation as shown at the upper side of FIG. 3A through FIG. 3C, in the first part of one frame the signal voltage is written in the pixel, and in the latter half all pixels are lit to make the display. The first half of one frame is therefore essentially a black display, and the image is displayed in the latter half. The circuit writes on each scanning line.

The lower side of FIG. 3A through FIG. 3C are timing charts for writing on the pixels. The circuit inputs a data signal during the signal line/triangular wave write period; and inputs a triangular wave during the light-emission period. The OLED drive TFT3 is the P-type so the triangular wave is a negative convex waveform. Here, a TFT that is the P-type, signifies that the TFT carriers are holes, and a TFT that is the N-type signifies that the TFT carriers are electrons.

In FIG. 3A, the lighting switch 2 turns on along with the reset switch 5 turning on. The precharge TFT switch 7 turns on while the lighting switch is on. If the precharge voltage potential is set near ground potential, then the anode side of the OLED is automatically set near ground potential. Moreover, the lighting TFT switch 2 is also turned on so the contact point voltage potential V3 for reset switch 5 and the lighting TFT switch 2 is also near ground potential. The reset TFT switch 5 is also on so that V1 which is the gate voltage for OLED drive TFT 3 also has a voltage near ground potential. In other words, the initial voltage V1 in the initial period of reset operation is near ground potential. The lighting TFT switch 2 then turns off, the data signal is written, and the lighting TFT switch 2 again turns on and reset is performed. In FIG. 3B, the reset switch 5 turns on while the lighting switch 2 is still off, and the precharge TFT switch 7 turns on. If the precharge voltage potential was set near ground potential, then the contact point voltage potential V3 for lighting TFT switch 2 and reset switch 5 and precharge TFT switch 7 are also set near ground potential. Since the reset TFT switch 5 is also on, then V1 which is the gate voltage for the OLED drive TFT 3 also has a voltage potential near ground potential. In other words, in the initial part of the reset operation, the initial V1 voltage is near ground potential. The lighting TFT switch 2 then turns off, the data signal is written, the lighting TFT switch 2 turns on and reset performed. In FIG. 3C, the precharge TFT switch 7 turns on while the lighting switch 2 and the reset switch 5 are still off. When the precharge voltage potential is set near ground potential, then V1 serving as the gate voltage for the OLED drive TFT3 is also has a voltage potential near ground potential. In other words, the initial voltage for V1 at the initial period of reset is near ground potential. The lighting TFT switch 2 then turns off, the data signal is written, the lighting TFT switch 2 turns on and reset performed.

The related art is unable to compensate the Vth of OLED drive TFT3 for variations or irregularities in V1, because the initial voltage of V1 is dependent on the display status of the prior frame and is undefined. Changes in the value where the initial voltage converges are a large factor in acquiring a voltage between the supply voltage to ground potential. In this invention however, the initial value for V1 is set near ground potential so that even if there are variations or irregularities in the Vth of the TFT, or even if the time for tc1 in FIG. 3 is not long enough, then the remaining differential in Vth that must be compensated can be rendered a small value.

In FIG. 1A through FIG. 1C and FIG. 3A through 3C, during reset, the data signal is written in storage capacitor 4 from signal line 54. The gate voltage for the OLED drive TFT3 then converges towards the cross point of the OLED drive TFT3 characteristic curve and the straight line V1=V3 when the reset TFT switch 5 and the lighting TFT switch 2 turn off. The signal voltage is then written via the storage capacitor 4 based on the voltage converging on this cross point.

When the write period ends, the lighting TFT switch 2 turns on and the light emission period begins. A triangular wave as shown in FIG. 3A through 3C is added to the signal line 54. The triangular wave decides the time the OLED drive TFT3 turns on via the voltage held in the storage capacitor 4. The longer the period that OLED drive TFT 3 is on, the greater the brightness becomes. The grey scale can now appear.

Figure 4A:
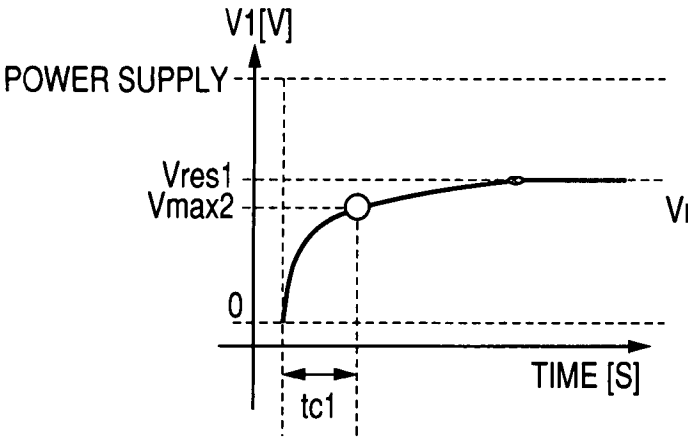
FIG. 4A is a graph showing transitions in the OLED drive TFT gate voltage of the first embodiment.
Figure 4B:
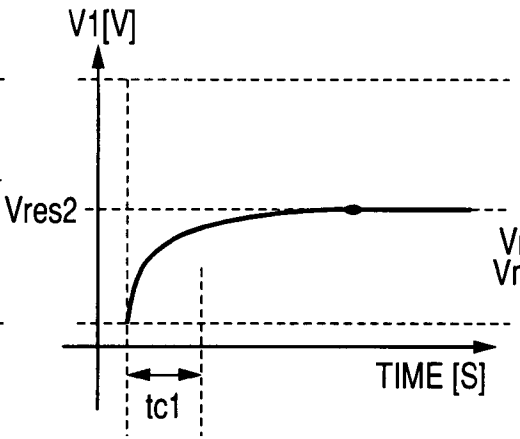
FIG. 4B is a graph showing transitions in the OLED drive TFT gate voltage of the first embodiment.
Figure 4C:
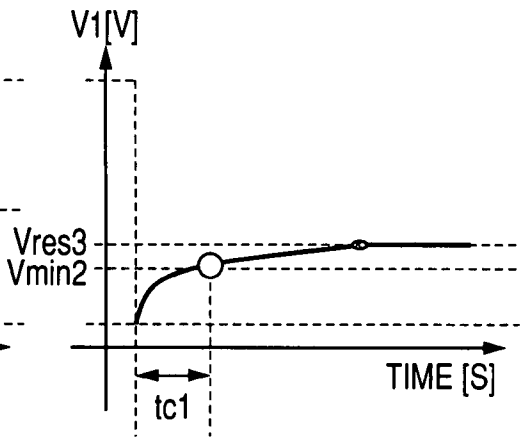
FIG. 4C is a graph showing transitions in the OLED drive TFT gate voltage of the first embodiment.
Figure 5:
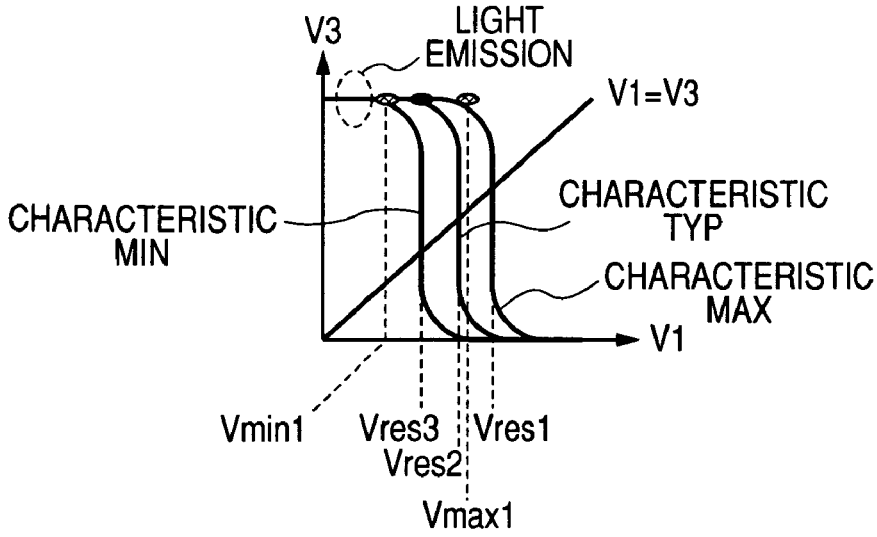
FIG. 5 is a graph showing the relation between the drain voltage and the gate voltage in the OLED drive TFT of the first embodiment.
Figure 6:
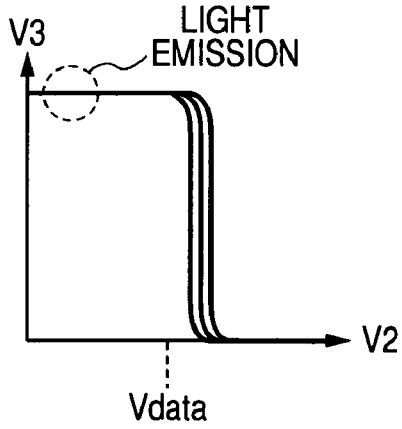
FIG. 6 is a graph showing the relation between the drain voltage of the OLED drive TFT and the image signal of the first embodiment.

The reset operation is next described using FIG. 4 through FIG. 6. The horizontal axis is the time, and the vertical axis in FIG. 4 is the gate voltage V1 for OLED drive TFT3 in FIG. 1. FIG. 4A is the case where the OLED drive TFT3 is operating at the characteristic MAX. As previously described, the precharge operation sets the initial voltage V1 near ground potential. Reset is performed when the TFT2 lighting switch and the reset TFT switch 5 simultaneously turn on, and this time is tc1 as shown in FIG. 3. In FIG. 4A, the OLED drive TFT 3 is operating at the characteristic MAX but when the time tc1 is not long enough, then the V1 voltage cannot converge on Vres1 as shown in FIG. 4A and stops at Vmax1. Here, the cross point formed by characteristic curve of OLED drive TFT3 when operating at the characteristic MAX and the straight line V1=V3 determine the Vres1. FIG. 4C shows the case where the OLED drive TFT3 is at the characteristic MIN. In this case also, when the time tc1 is too short, the gate voltage V1 for OLED drive TFT3 cannot converge at Vres3, and stops at Vmin1. Here, Vres1 is a voltage determined by the cross point formed by the characteristic curve for OLED drive TFT3 when operating at characteristic MIN and the straight line V1=V3. In FIG. 4B, the gate voltage V1 for the OLED drive TFT3 is a value between FIG. 4A and FIG. 4C. As can be understood from FIG. 4, even when the convergence time tc1 is short and there is not enough time for converging on voltage potential V1, the value where the Vth of OLDE drive TFT3 cannot be compensated is in a range (Vres1-Vmax1)-(Vres3-Vmin1) and this is not a large value. This result is obtained because the initial values for V1 are all set near ground potential.

FIG. 5 is drawing showing how the operation point for reset operation is set when the OLED drive TFT3 and the OLED element 1 are seen as an inverter. In FIG. 5, the line V1=V3 shows the state where the reset TFT switch 5 shorts the gate and drain of OLED drive TFT3. If the reset time tc1 is long enough, then the operation point settles at the cross point of the characteristic curve for OLED drive TFT3 and the straight line V1=V3 in all cases. However since tc1 is too short, then the voltage for each case is set to Vmin1 for the characteristic MIN, or set to Vmax1 for the characteristic MAX. In FIG. 5, the voltage potential for V1 is set in each case on the side where V1 is smaller than the cross point of each inverter characteristic and V1=V3. The variations or irregularities in the voltage remaining after reset are therefore small in each case.

This state (small V1) is shown in FIG. 6. The vertical axis in FIG. 6 is the drain voltage of OLED drive TFT3 that regulates light emission from OLED element 1 and is the voltage V3 in FIG. 1. The drain voltage V3 of OLED drive TFT3 is a voltage approximately equal to the anode of OLED element 1 while lit. The horizontal axis is the signal voltage at V2 shown in FIG. 1. The variations or irregularities in the characteristics of drain voltage V3 for OLED drive TFT3 versus the signal voltage V2 are small as can be seen in FIG. 6.

Second Embodiment

Figure 7A:
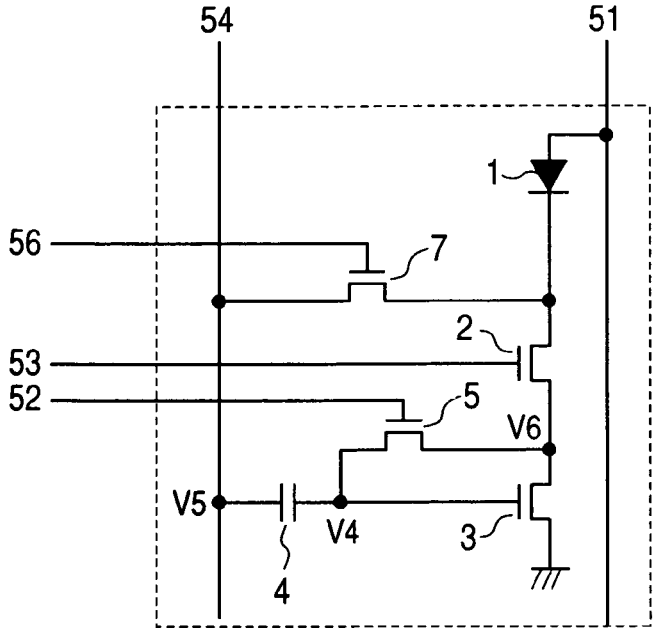
FIG. 7A is a first structure of the pixel drive circuit of the second embodiment.
Figure 7B:
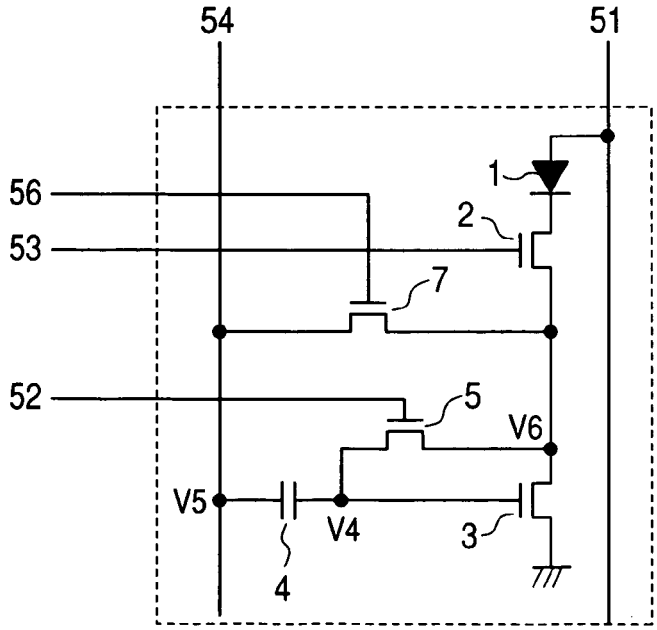
FIG. 7B is a second structure of the pixel drive circuit of the second embodiment.
Figure 7C:
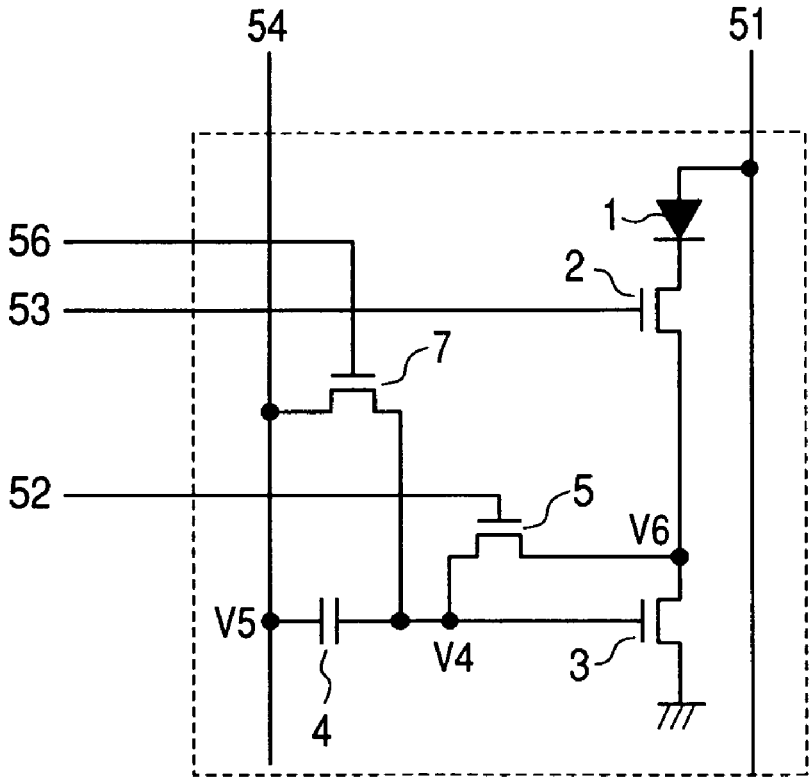
FIG. 7C is a third structure of the pixel drive circuit of the second embodiment.

FIG. 7A-FIG. 7C through FIG. 12 are diagrams showing the second embodiment of this invention. FIG. 7A through FIG. 7C show the drive circuits for the pixel section of the second embodiment. This embodiment differs from the first embodiment of FIG. 1A through FIG. 1C. In that the OLED element 1 is directly connected to the power supply line 51, and that the OLED drive TFT3 is installed on the ground side. Also the preset TFT switch 5 is connected to the negative side of OLED element 1. An N-type TFT is utilized as the OLED drive TFT3 in this embodiment. The TFT within the pixel is therefore only capable of N-type processing. The OLED element 1 is installed on the power supply line side and other than the fact that related elements are shifted by installing OLED element TFT3 on the ground side, the operation is essentially the same as in FIG. 1A through FIG. 1C.

Figure 8:
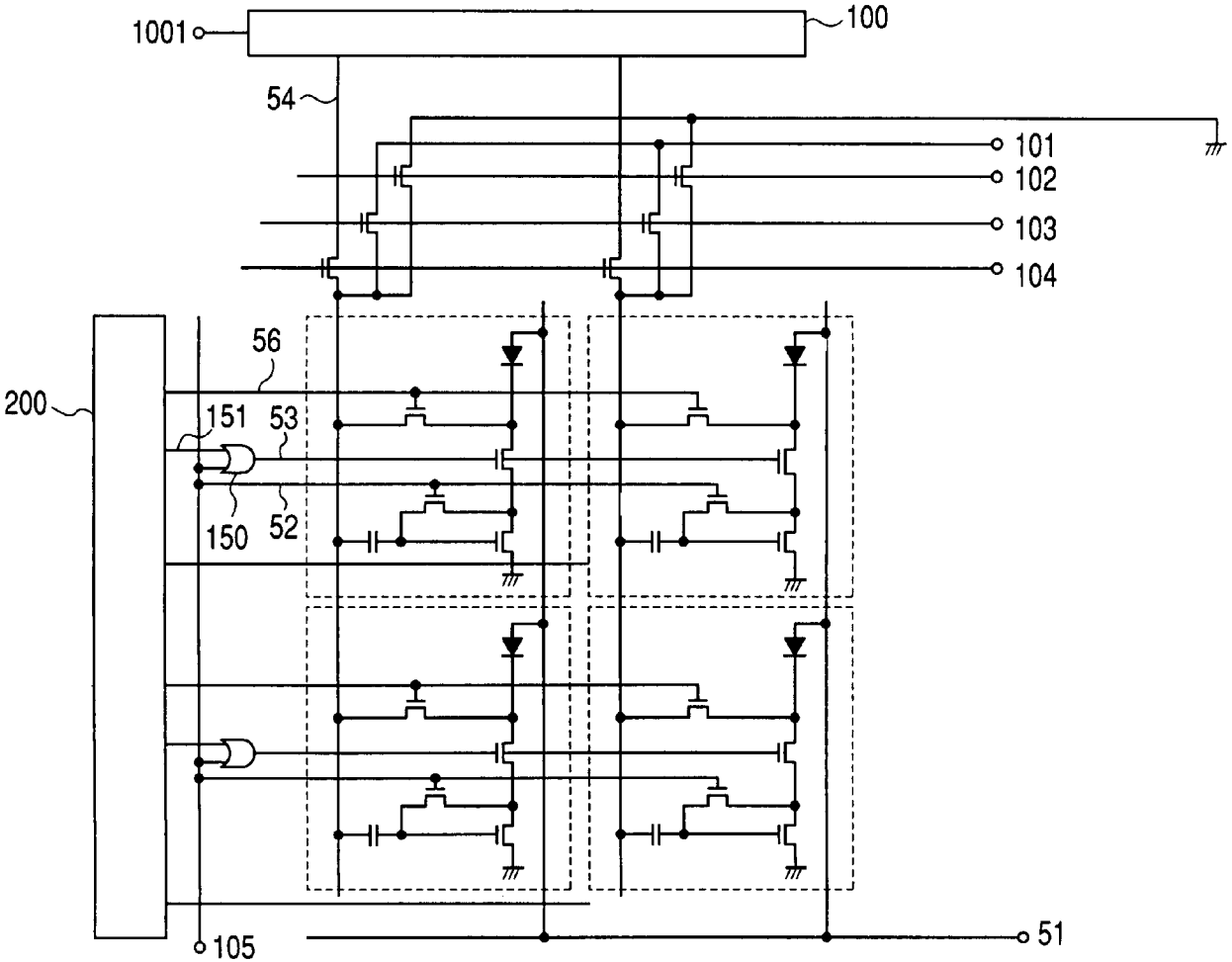
FIG. 8 is a circuit diagram of the display apparatus drive circuit of the second embodiment.

FIG. 8 is a circuit diagram showing the structure of the overall display apparatus of the second embodiment. The actual screen is made up of many pixels but only four pixels are shown in FIG. 8. Other than the structure of the pixel section in FIG. 8, the structure is the same as the overall structure of the image display apparatus in the first embodiment of FIG. 2.

Figure 9A:
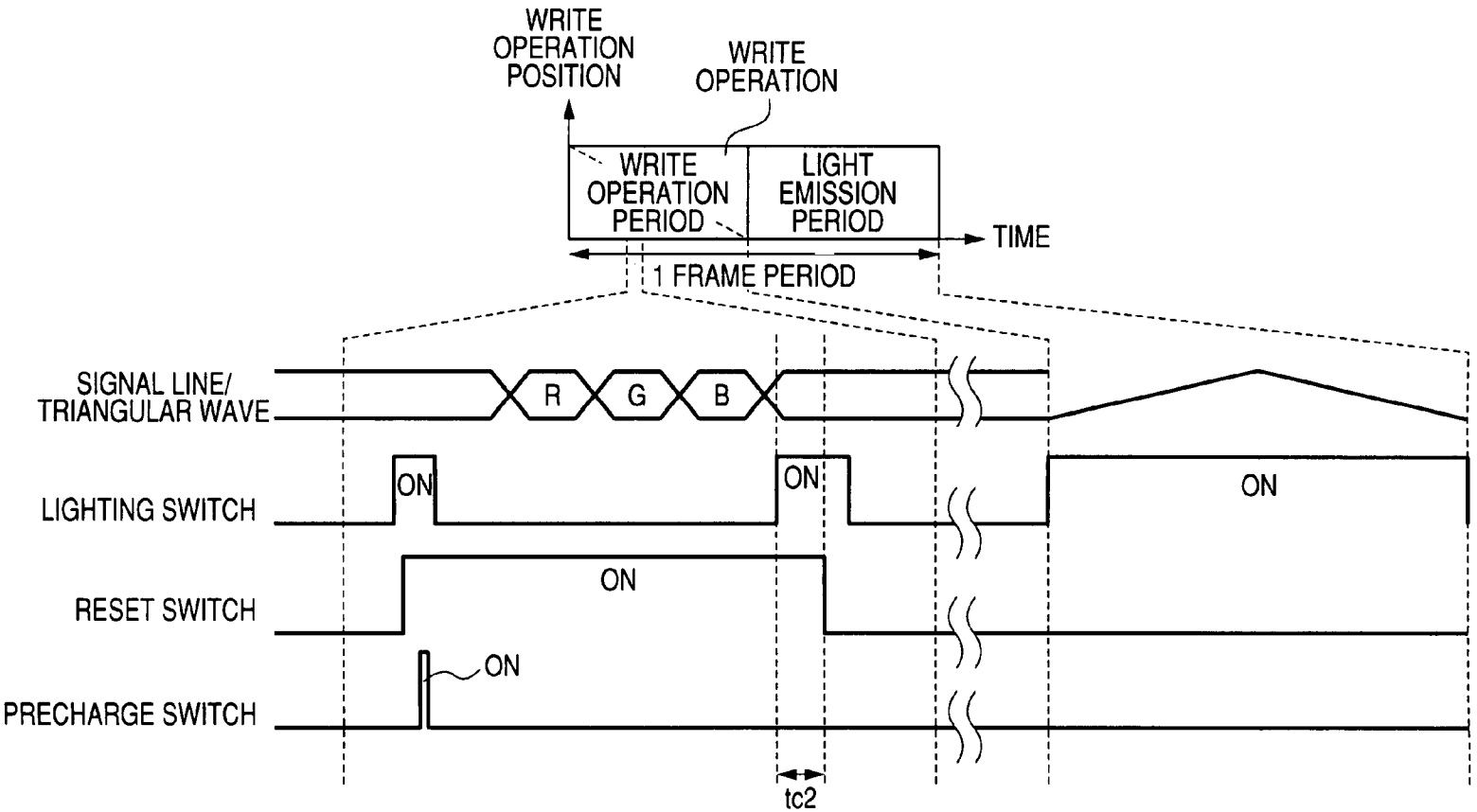
FIG. 9A is a timing chart of FIG. 7A.
Figure 9B:
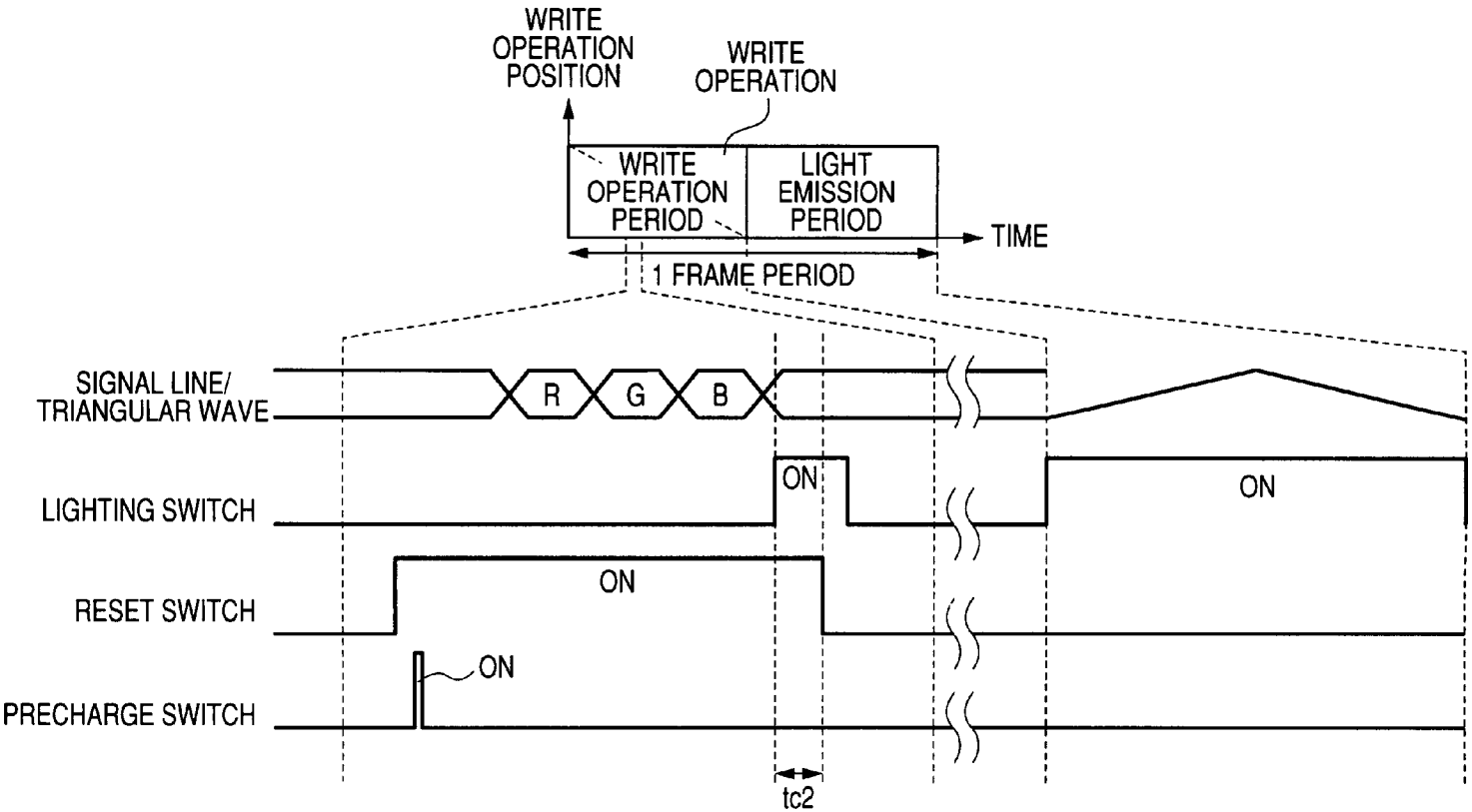
FIG. 9B is a timing chart of FIG. 7B.
Figure 9C:
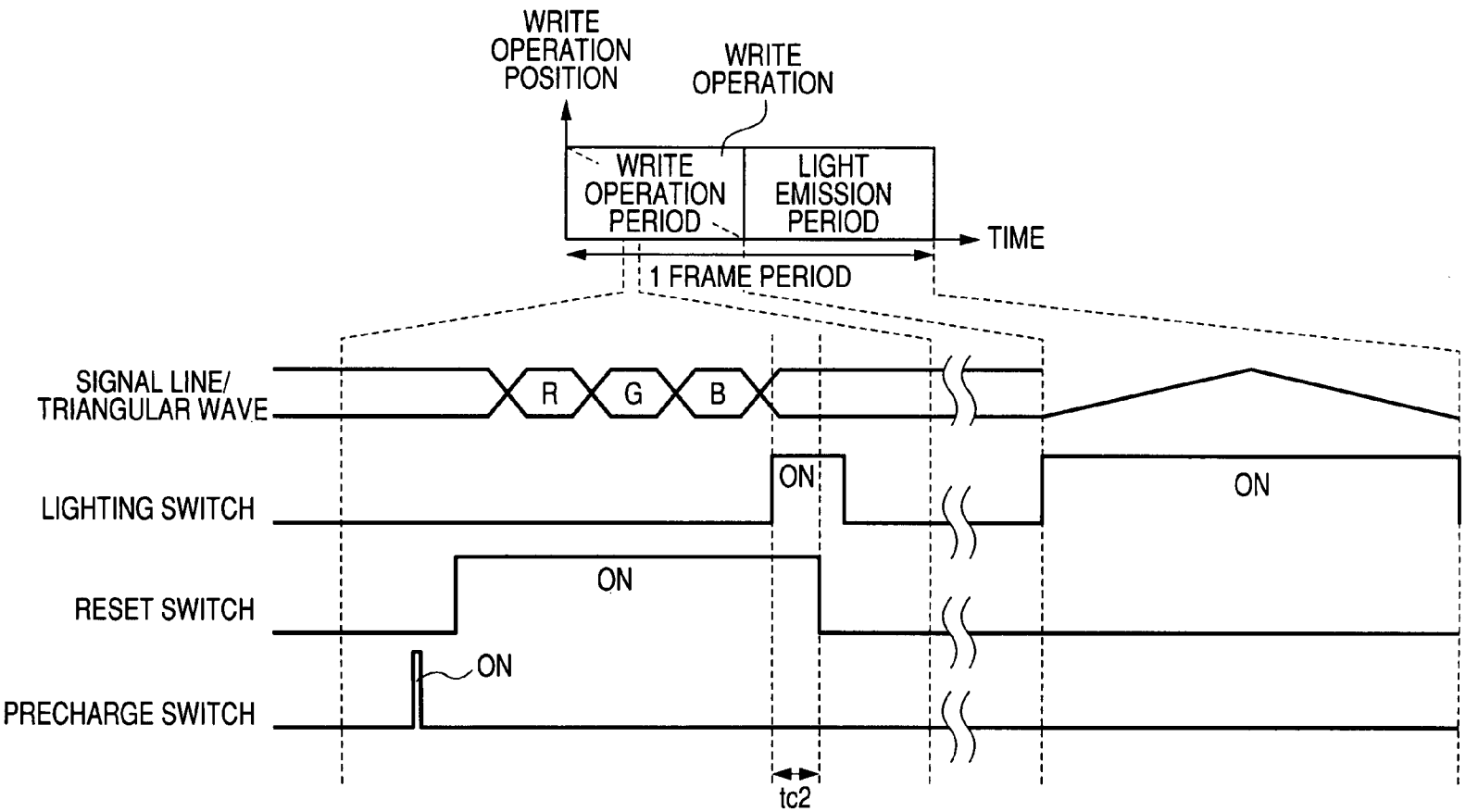
FIG. 9C is a timing chart of FIG. 7C.

FIG. 9A through FIG. 9C are timing charts showing the driving of the circuits in FIG. 7A through FIG. 7C and FIG. 8. The operation in FIG. 9A through FIG. 9C is basically the same as the operation in FIG. 3A through FIG. 3C in the first embodiment. The time utilized for reset is set as tc2. The time required for reset is related to the OLED drive TFT3 characteristics. In the first embodiment, the OLED drive TFT3 was a P-type device but in this second embodiment is an N-type device so the first embodiment and the second embodiment differ from each other. FIG. 9A through FIG. 9C differ from FIG. 3A through FIG. 3C in another point which is that the triangular wave peaks upward during the light emission period. The OLED drive TFT3 is an N-type device and so the OLED drive TFT3 turns on when the gate voltage is positive.

Figure 10A:
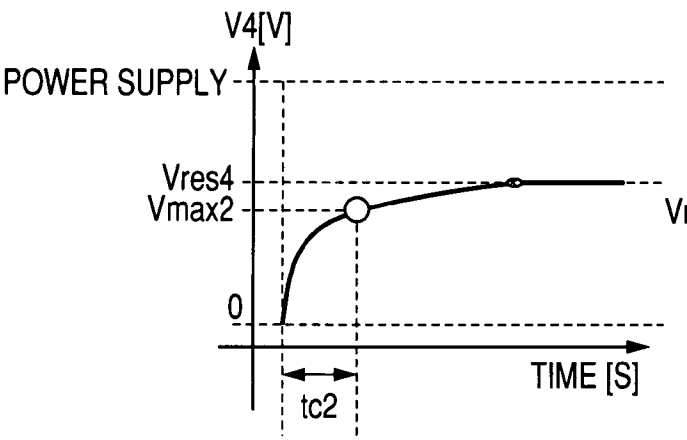
FIG. 10A is a graph showing voltage transitions at the gate of the OLED drive TFT of the second embodiment.
Figure 10B:
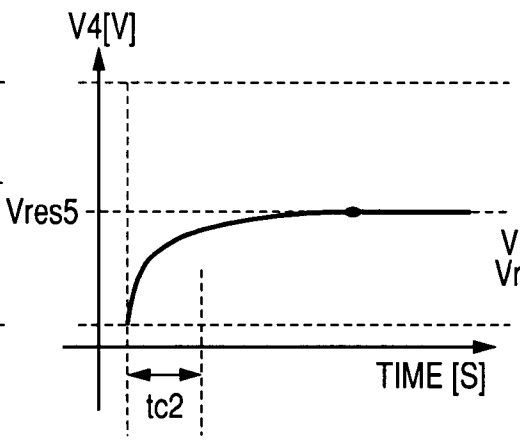
FIG. 10B is a graph showing voltage transitions at the gate of the OLED drive TFT of the second embodiment.
Figure 10C:
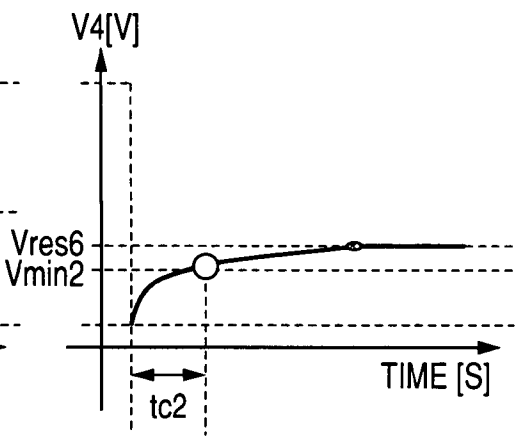
FIG. 10C is a graph showing voltage transitions at the gate of the OLED drive TFT of the second embodiment.
Figure 11:
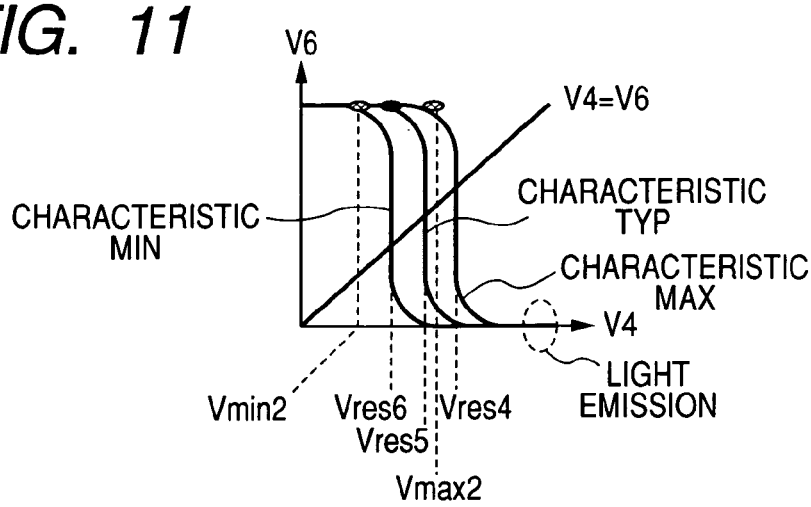
FIG. 11 is a graph showing the relation between the drain voltage and the gate voltage in the OLED drive TFT of the second embodiment.
Figure 12:
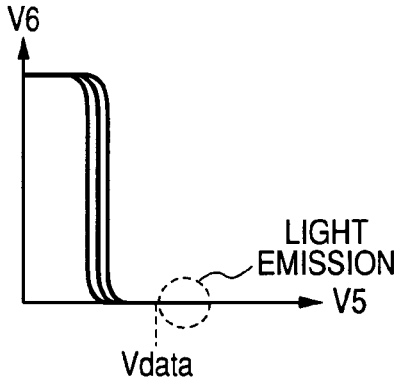
FIG. 12 is a graph showing the relation between the drain voltage of the OLED drive TFT and the image signal in the second embodiment.

FIG. 10 through FIG. 12 are drawings show the reset operation of the second embodiment. In FIG. 10, the horizontal axis is the time, and the vertical axis is the gate voltage V4 for OLED drive TFT3 in FIG. 7A through 7C. FIG. 10A shows the case where the OLED drive TFT3 is operating at the characteristic MAX. The precharge operation sets the initial voltage of V4 near ground potential. Reset is performed when the lighting TFT switch 2 and the reset switch 5 are simultaneously on, and this time is tc2 as shown in FIG. 9. The case where the OLED drive TFT3 is operating at the characteristic MAX is shown in FIG. 10A however if the time tc2 is not long enough, then as shown in FIG. 10A, the V1 voltage potential cannot converge on Vres4, and stops at Vmax2. Here, the cross point of the line V4=V6 and the characteristic curve for OLED drive TFT3 when operating at characteristic MAX determines the Vres4. FIG. 10C shows the case where the gate voltage V4 for OLED drive TFT3 operates at the characteristic MIN. In this case also, if the tc2 time is not long enough then the gate voltage V4 for the OLED drive TFT3 cannot converge at Vres6, and stops at Vmin2. The cross point of the straight line V4=V6 and the characteristic curve for OLED drive TFT3 when operating at characteristic MIN determines the voltage Vres6 here. In FIG. 10B, the gate voltage V4 for the OLED drive TFT3 is a value between FIG. 10A and FIG. 10C. As can be understood from FIG. 10, even when the convergence time tc2 is short and there is not enough time for converging on voltage potential V4, the value where the Vth of OLED drive TFT3 cannot be compensated is in a range (Vres4-Vmax2)-(Vres4-Vmin2) but is not a large value. This result is obtained because the initial values for V4 are all set near ground potential.

FIG. 11 is drawing showing how the operation point for reset operation is set when the OLED drive TFT3 and the OLED element 1 are seen as an inverter. In FIG. 11 the line V4=V6 shows the state where the reset TFT switch 5 shorts the gate and drain of OLED drive TFT3. If the reset time tc2 is long enough, then the operation point settles at the cross point of the characteristic curve for the OLED drive TFT3 and the straight line V4=V6 in all cases. However since tc2 is too short, then the voltage for each case is set to Vmin2 for the characteristic MIN, or set to Vmax2 when the OLED drive TFT3 is the characteristic MAX. In FIG. 11, the voltage potential for V4 is set in each case on the side where the V4 is smaller than the cross point of each inverter characteristic and V4=V6. Variations or irregularities in the voltage remaining after reset are therefore small in each case.

This state (small V1) is shown in FIG. 12. The vertical axis in FIG. 6 is the drain voltage of OLED drive TFT3 that regulates light emission from OLED element 1 and is the voltage V6 in FIG. 7. The horizontal axis is the signal voltage at V5 shown in FIG. 7. Variations or irregularities in the characteristics of drain voltage V3 for OLED drive TFT3 versus the signal voltage V2 are small as can be seen in FIG. 6.

Third Embodiment

FIG. 13A-FIG. 13C through FIG. 18 are diagrams showing the third embodiment of this invention. The third embodiment provides countermeasures to resolve the problems in the comparative example 2. The drive circuit of the third embodiment for the pixels is shown in FIG. 13. The problem with the second example of the related art is that even if reset is performed with the reset TFT switch 5, if that reset time is too short, then the Vth of the OLED drive TFT3 cannot be sufficiently cancelled out during the reset time and an accurate gray scale cannot be displayed. A major cause of this problem is that as described for the second example of the related art, the gate voltage potential of the OLED drive TFT3 is undefined (not fixed) prior to cancel at times such as at power supply startup and is either at least the power supply voltage or ground potential so that the voltage potential varies after reset if the reset time is not long enough.

Figure 13A:
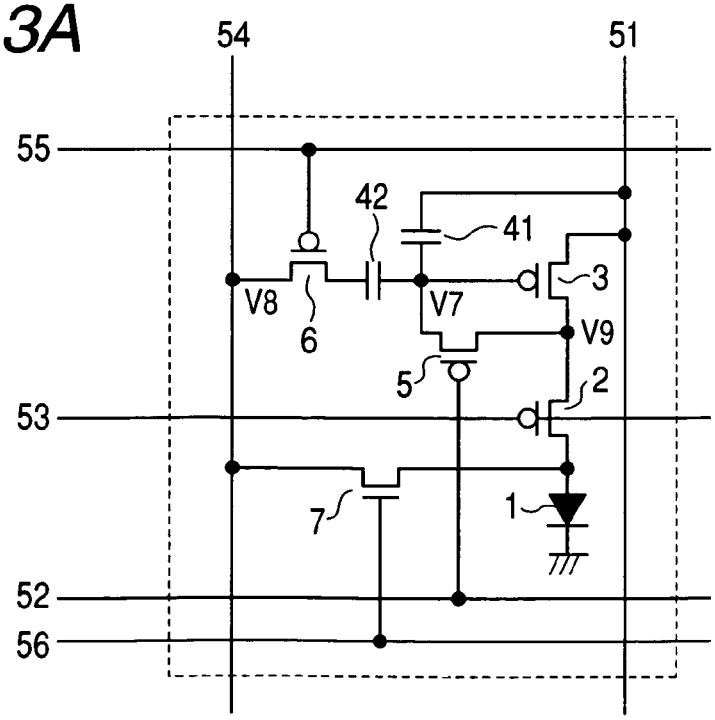
FIG. 13A is a first structure of the pixel drive circuit of the third embodiment.
Figure 13B:
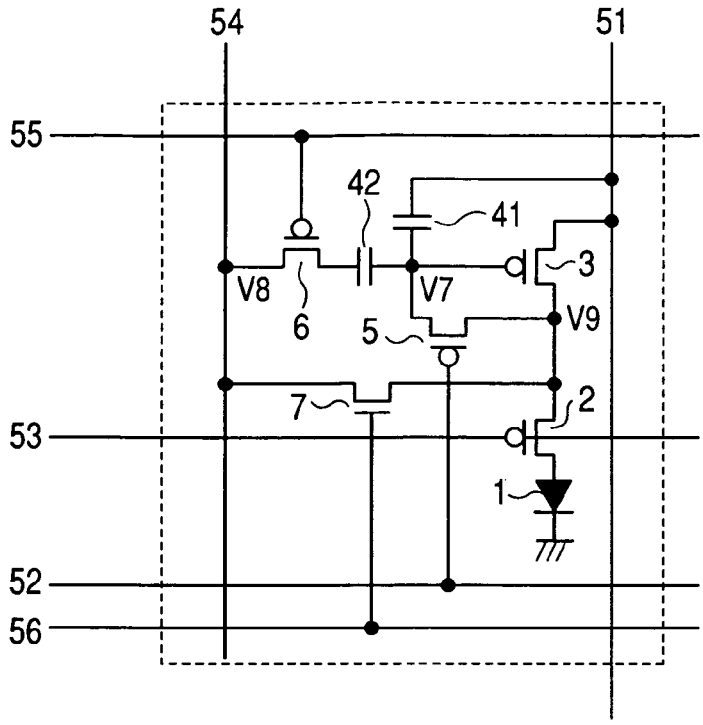
FIG. 13B is a second structure of the pixel drive circuit of the third embodiment.
Figure 13C:
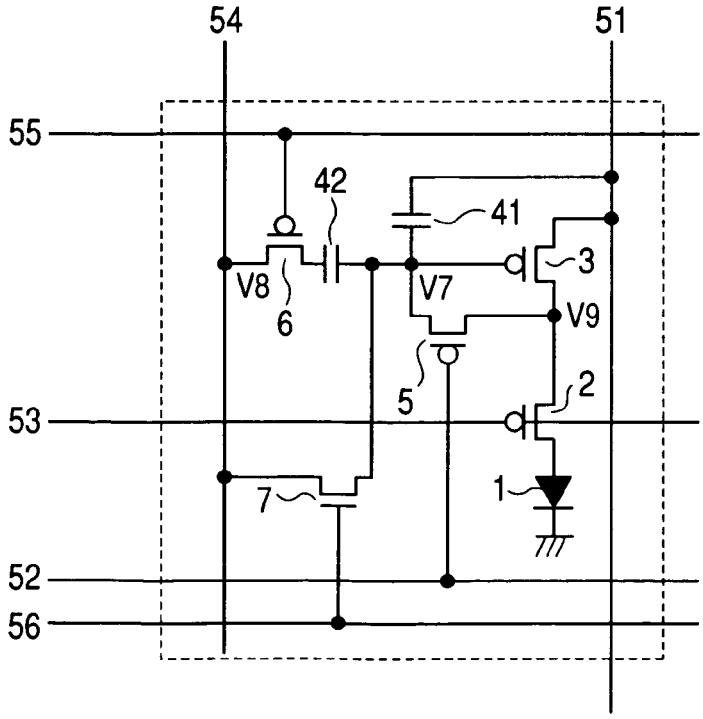
FIG. 13C is a third structure of the pixel drive circuit of the third embodiment.

In order to resolve the problems with the second example of the related art, in the third embodiment as shown in FIG. 13A through 13C, a precharge switch 7 applies a precharge voltage to the positive terminal of the OLED element 1, and applies a precharge voltage serving as a fixed voltage to the positive terminal of the OLED prior to reset, to set the initial voltage of gate voltage V7 to a fixed value prior to reset.

Figure 14:
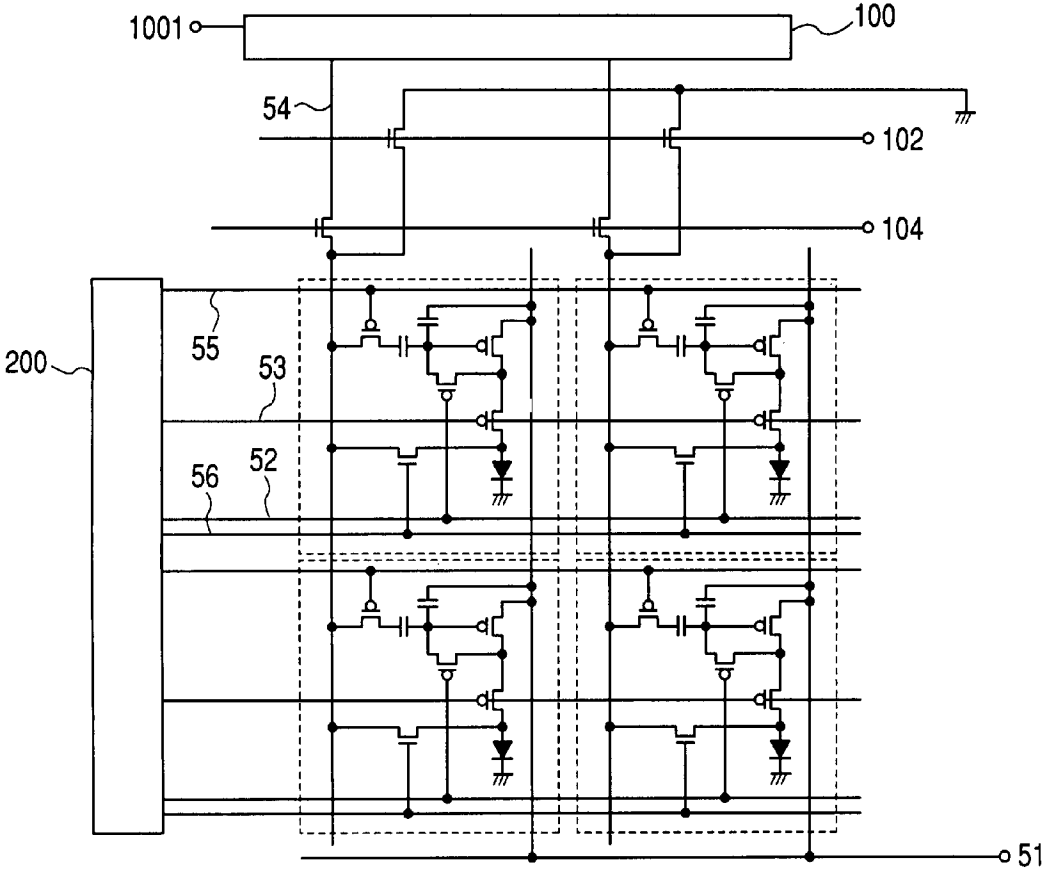
FIG. 14 is a circuit diagram of the pixel drive circuit of the third embodiment.

FIG. 14 is a circuit diagram showing the overall structure of the image display apparatus of the third embodiment. The actual screen is made up of many pixels but only four pixels are shown in FIG. 14. In FIG. 14, a gate drive circuit 200 is installed at the side of the screen. The gate drive circuit 200 sends outputs on the select switch 55, the lighting switch line 53, the reset line 52, and the precharge control line 56. The select switch line 55 connects to the gate of select switch 6, and the lighting switch line 53 connects to the gate of the lighting TFT switch 2, and the reset line 52 connects to the gate of the reset TFT switch 5, and the precharge control line 56 connects to the gate of the precharge TFT switch 7.

A signal drive circuit 100 is installed on the upper side in the screen. A precharge supply line for supplying a precharge signal as the ground potential, a precharge signal select line 102, and a signal line select switch control line 104 extend between the signal drive circuit 100 and the screen. These outputs are applied at different times (time differentials) by the switching TFT to the signal line 54 extending from the signal drive circuit 100. A select switch 6 source and a precharge TFT source are connected to the signal line 54.

Figure 15:
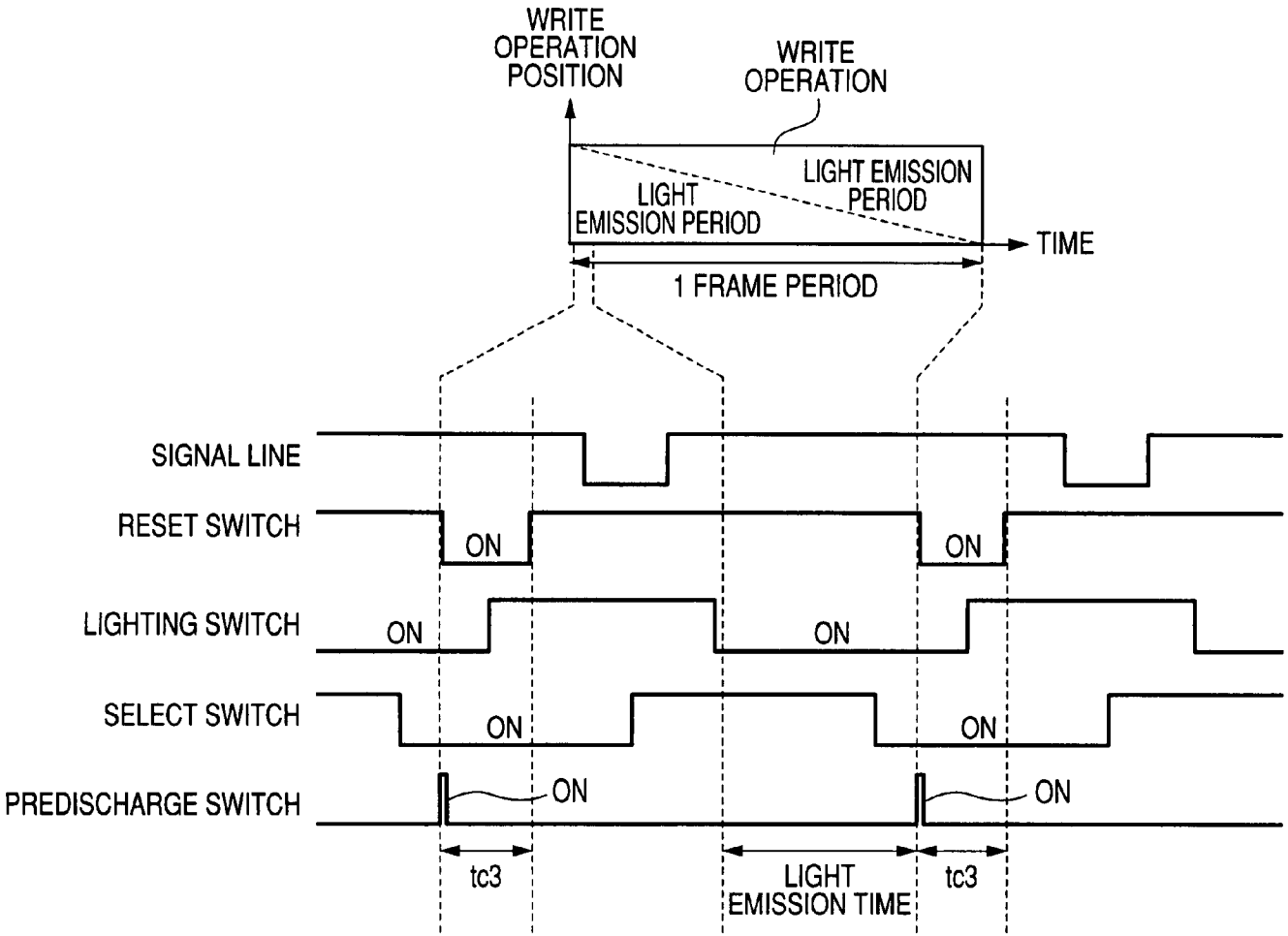
FIG. 15 is a timing chart of the third embodiment.

FIG. 15 is a timing chart showing the circuit operation in FIG. 13A through FIG. 13C and FIG. 14. Unlike the first embodiment and second embodiment, in this circuit the OLED element 1 promptly starts emitting light when the signal is written, and that state is maintained for one frame period. This operation is shown on the upper side of the drawing in FIG. 15. This figure on the upper side of FIG. 15 shows that write is performed at each scan.

The lower side of FIG. 15 is timing charts for the operations to write and to reset each pixel. In FIG. 13A through 13C and in FIG. 15, the lighting switch is on until a specified select line is selected. Turning on the select switch 6 selects a specified select switch line 55. Besides turning on the precharge TFT switch 7 here, turning on the reset TFT switch 5 causes electrical current to flow in the OLED element 1, and set the anode of the OLED element 1 near ground potential which is the voltage potential of the reset line 52. The gate voltage potential V7 of OLED drive TFT 3 is also set near ground potential at the same time. When the lighting switch is later turned off, electrical current flows to recharge the first storage capacitor 41, and the gate voltage of OLED drive TFT3 is set to the voltage potential of the power supply voltage minus the Vth of OLED drive TFT3. Signals from the signal line 54 are written while in this state. In other words, the gate of OLED drive TFT3 is added to a signal voltage somewhat higher than a reference potential of the power supply voltage minus the Vth of OLED drive TFT3 so that effects due to variation in the Vth can be compensated.

In the related art shown in FIG. 15, when tc3 or in other words, the time that the lighting switch is on and the time that the reset switch is on are not long enough, then the gate voltage of OLED drive TFT3 could not converge at a voltage which is the power supply voltage minus the Vth of OLED drive TFT3 during the reset period. The cause of this failure was the gate voltage V7 of OLED TFT3 is undefined (not fixed) prior to reset and so the voltage potential might appear at levels from the supply voltage to ground potential. The present embodiment however also sets the gate voltage V7 of OLED drive TFT3 near ground potential by supplying a ground potential to the anode of OLED element 1 via the precharge control line 56 prior to reset. The precharging operation suppresses variations in the gate voltage of OLED drive TFT3 even if the reset time tc3 is short.

Figure 16A:
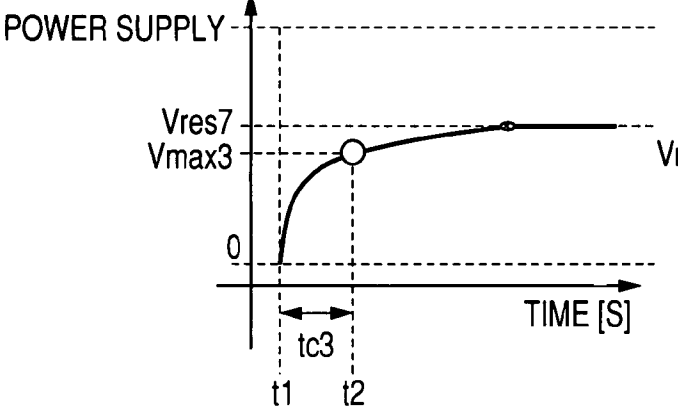
FIG. 16A is a graph showing voltage transitions at the gate of the OLED drive TFT gate of the third embodiment.
Figure 16B:
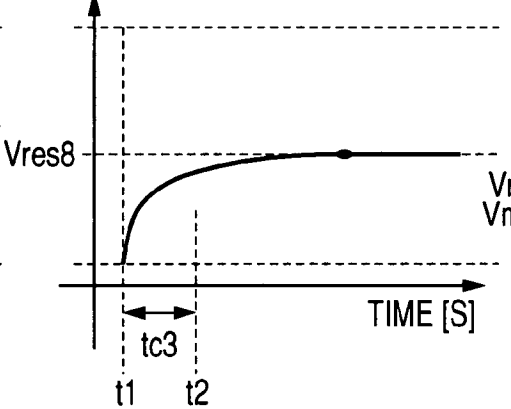
FIG. 16B is a graph showing voltage transitions at the gate of the OLED drive TFT gate of the third embodiment.
Figure 16C:
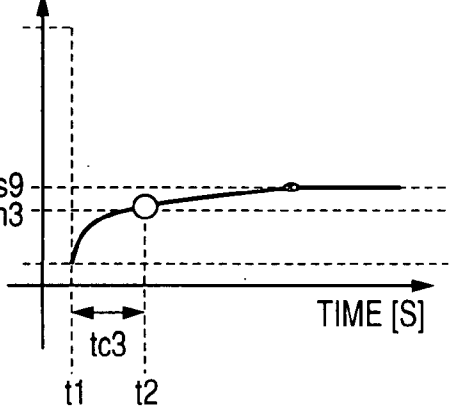
FIG. 16C is a graph showing voltage transitions at the gate of the OLED drive TFT gate of the third embodiment.

FIGS. 16A to 16C through FIG. 18 are graphs showing the above reset operation. In FIGS. 16A to 16C, the horizontal axis is the time, and the vertical axis is the gate voltage V7 of the OLED drive TFT3 in FIG. 13. FIG. 16A shows the case where the threshold voltage Vth of OLED drive TFT is small. As described previously, the initial voltage of V1 is first of all set near ground potential by the precharging operation. Reset is performed while the lighting TFT switch 2 and reset TFT switch 5 are simultaneously on, and this time is tc3 as shown in FIG. 15.

In the case in FIG. 16A, the Vth for OLED drive TFT3 is small but if the time tc3 is not long enough, then V7 voltage potential cannot converge on Vres7 as shown in FIG. 16A and stops in Vmax3. Here, Vres7 is a value where the threshold voltage Vth of OLED drive TFT3 is subtracted from the power supply voltage. FIG. 16C shows the case where the Vth for OLED drive TFT3 is large. In this case also, the gate voltage V7 of OLED drive TFT3 cannot converge on Vres9 if the time tc3 is too short, and stops in Vmin3. When the threshold voltage Vth of OLED drive TFT 3 is large, then the Vres9 is a value where the threshold voltage Vth of OLED drive TFT3 is subtracted from the power supply voltage. FIG. 16B is a value where the gate voltage V7 of OLED drive TFT3 is at the midpoint between the range in FIG. 16A and FIG. 16C.

As shown in FIGS. 16A to 16C, the uncompensated Vth for OLED drive TFT 3 is in a range of (Vres7-Vmax3)-(Vres9-Vmin3) and is not a large value, even when the convergence time tc3 is short and there is insufficient time for V7 to converge. This result is obtained because the initial valve for V1 is set near ground potential in all cases.

Figure 17:
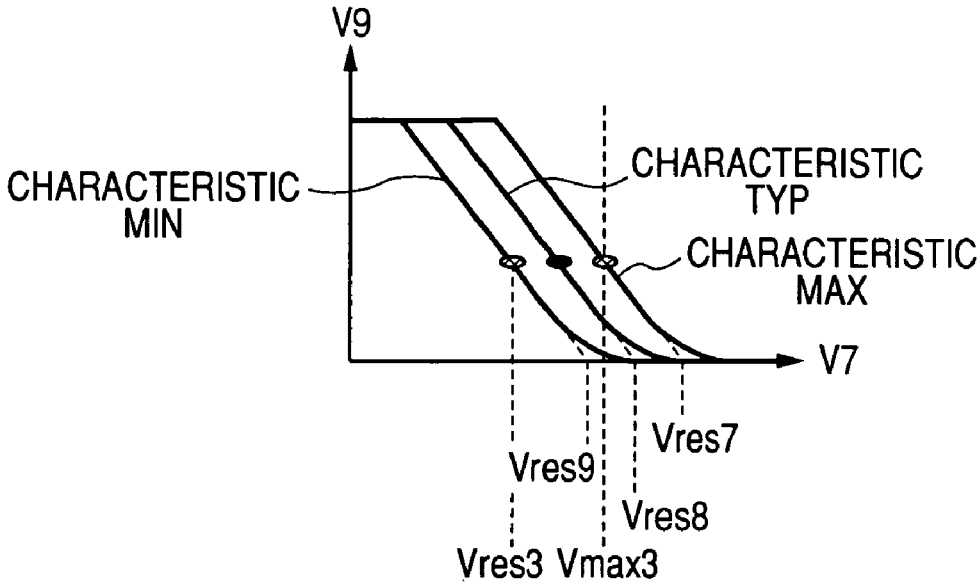
FIG. 17 is a graph showing the relation between the drain voltage and gate voltage of the OLED drive TFT of the third embodiment.

FIG. 17 is a graph showing the relation between the gate voltage V7 of OLED drive TFT3 and the drain voltage V9 of OLED drive TFT3. The corresponding characteristic curves for the characteristic MAX is shown in FIG. 16A, and for the characteristic TYP in FIG. 16B, and for the characteristic MIN in FIG. 16C. Here, at the characteristic MAX, V7 converges on Vres7 if the reset time tc3 is sufficient. However the reset time tc3 is too short so V7 stops in Vmax3. At the characteristic MIN, V7 converges on Vres9 if the reset time tc3 is sufficient. However the reset time tc3 is too short so V7 stops in Vmin3.

Therefore even when the OLED drive TFT3 characteristics vary the most, the gate voltage V7 variations or irregularities can be contained within a range of (Vres7-Vmax3)-(Vres9-Vmin3) after reset. Effects from variations in each OLED drive TFT3 on the light emission gray scale can therefore be reduced.

Figure 18:
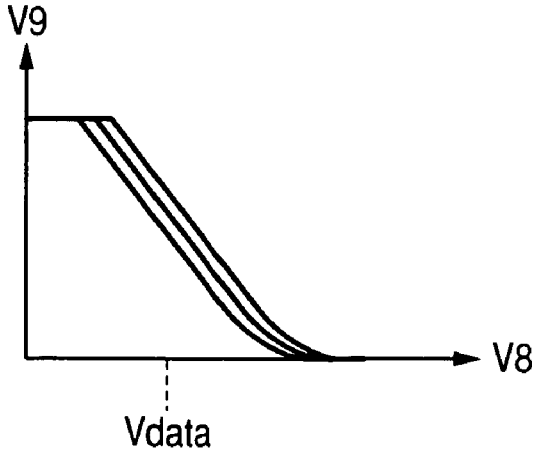
FIG. 18 is a graph showing the relation between the drain voltage of the OLED drive TFT and the image signal of the third embodiment.
Figure 19:
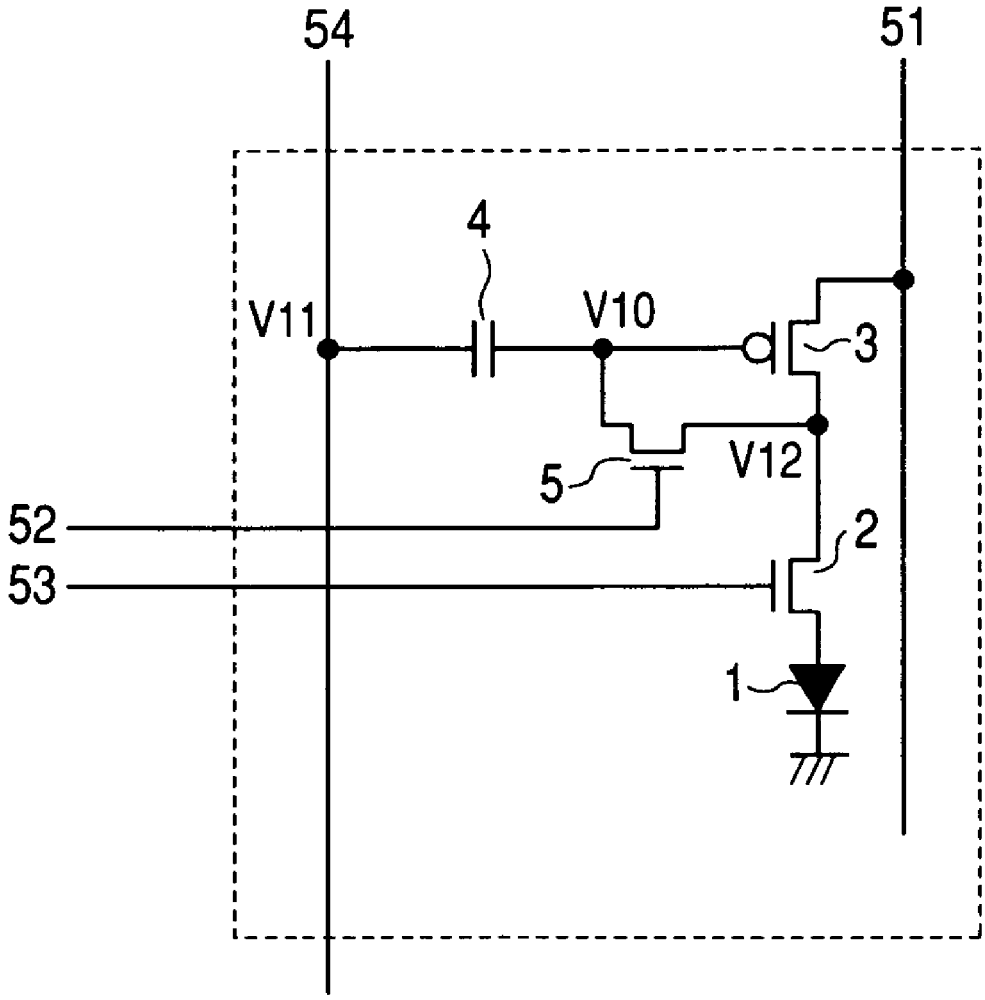
FIG. 19 is a circuit diagram of the pixel drive circuit of the first example of the related art.
Figure 20:
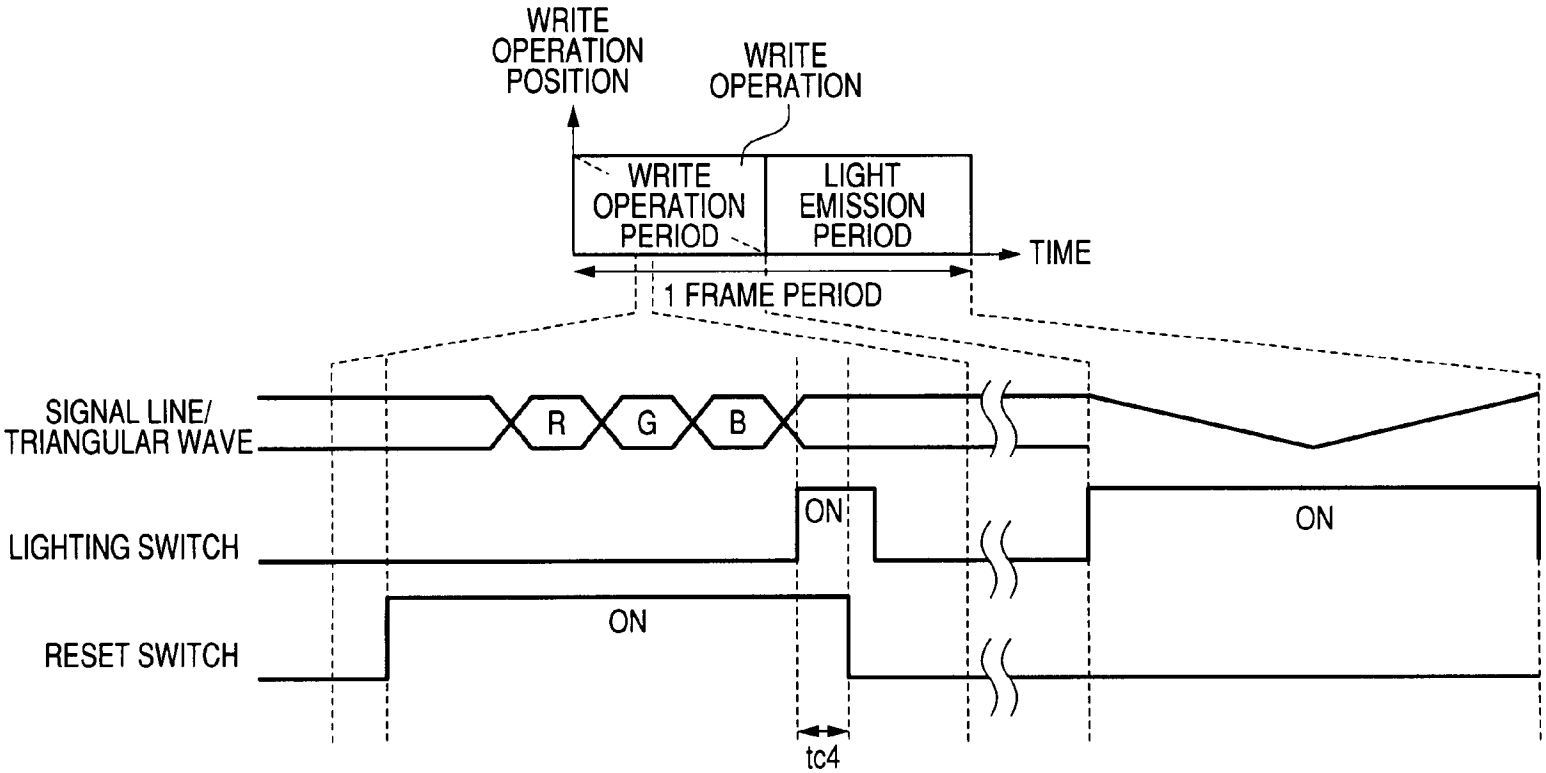
FIG. 20 is a timing chart of the first example of the related art.
Figure 21A:
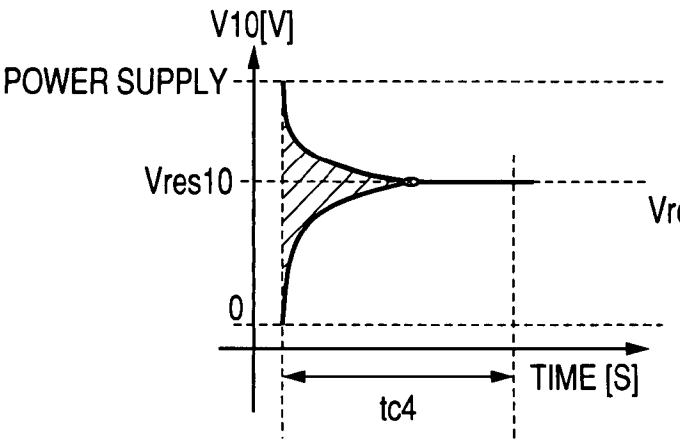
FIG. 21A is a graph showing voltage transitions at the gate of the OLED drive TFT of the first example of the related art.
Figure 21B:
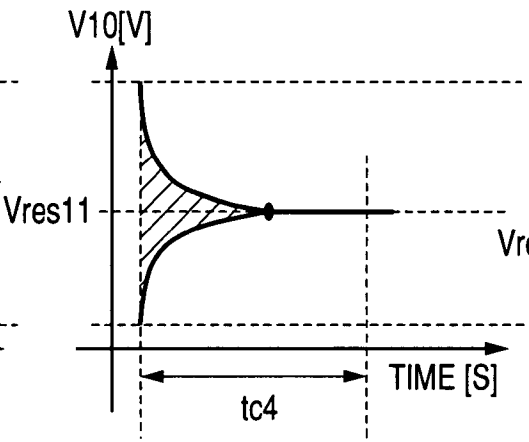
FIG. 21B is a graph showing voltage transitions at the gate of the OLED drive TFT of the first example of the related art.
Figure 21C:
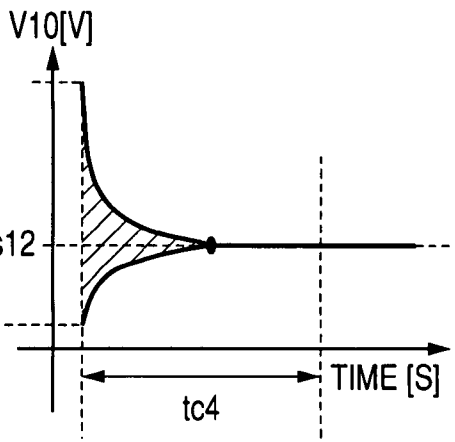
FIG. 21C is a graph showing voltage transitions at the gate of the OLED drive TFT of the first example of the related art.
Figure 22:
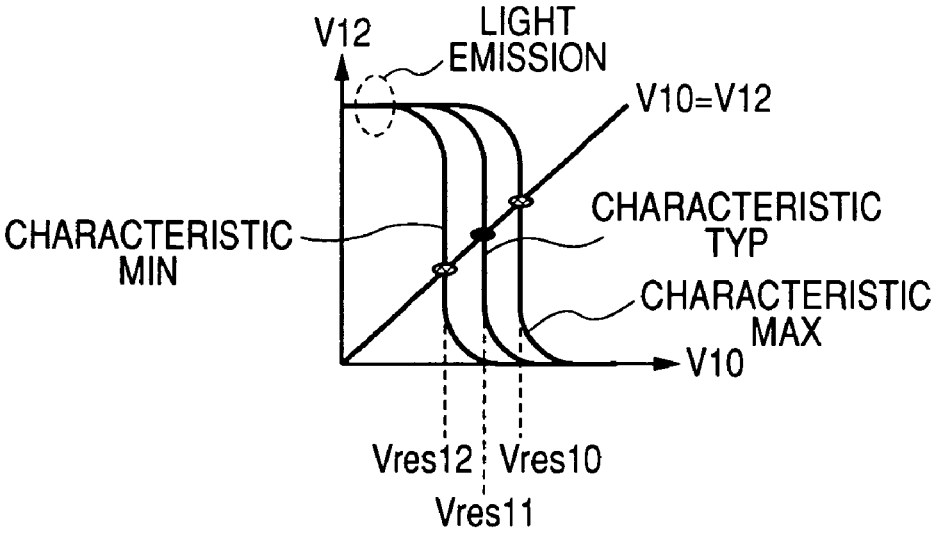
FIG. 22 is a graph showing the relation between the drain voltage and gate voltage of the OLED drive TFT of the first example of the related art.
Figure 23:
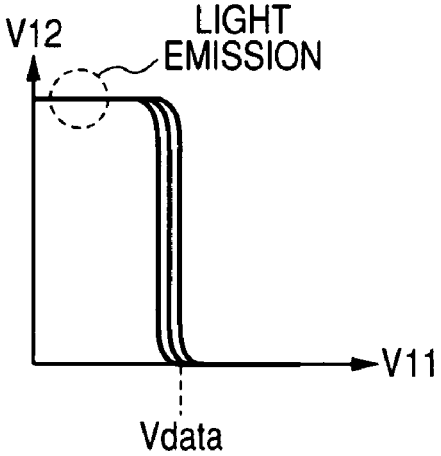
FIG. 23 is a graph showing the relation between the drain voltage of the OLED drive TFT and the image signal in the first example of the related art.
Figure 24A:
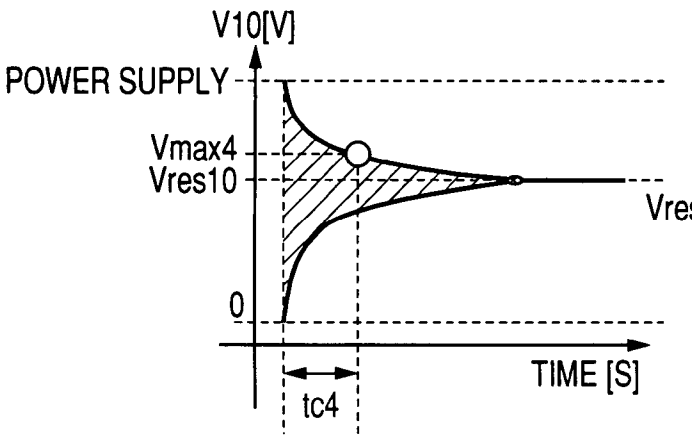
FIG. 24A is a graph showing voltage transitions in the gate voltage of another OLED drive TFT of the first example of the related art.
Figure 24B:
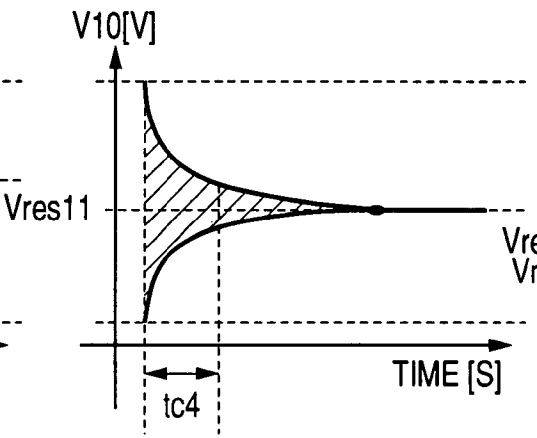
FIG. 24B is a graph showing voltage transitions in the gate voltage of another OLED drive TFT of the first example of the related art.
Figure 24C:
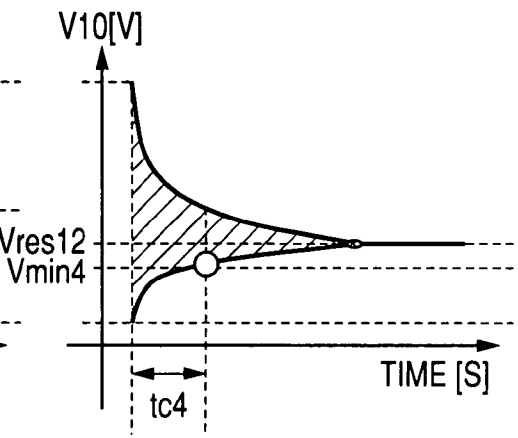
FIG. 24C is a graph showing voltage transitions in the gate voltage of another OLED drive TFT of the first example of the related art.
Figure 25:
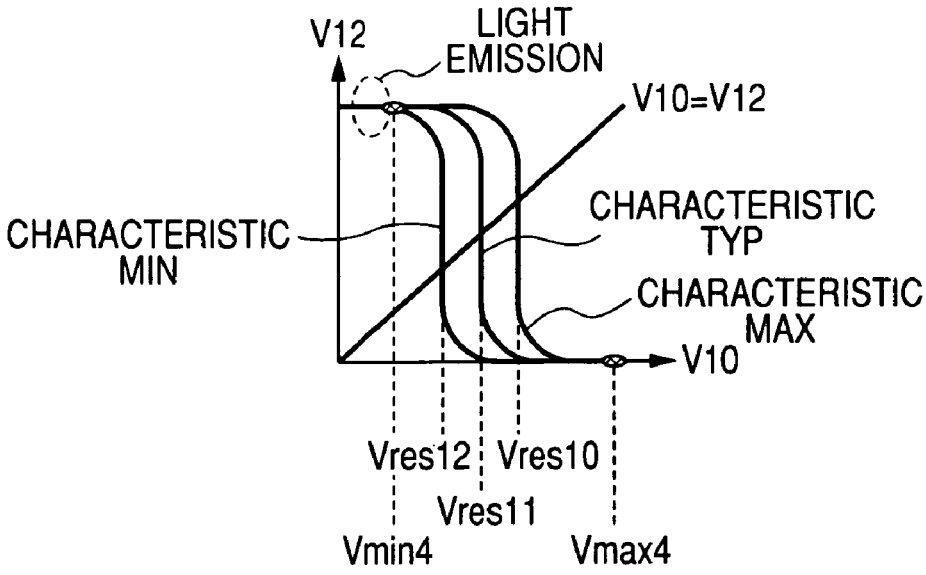
FIG. 25 is a graph showing the relation between the drain voltage and the gate voltage of another OLED drive TFT of the first example of the related art.
Figure 26:
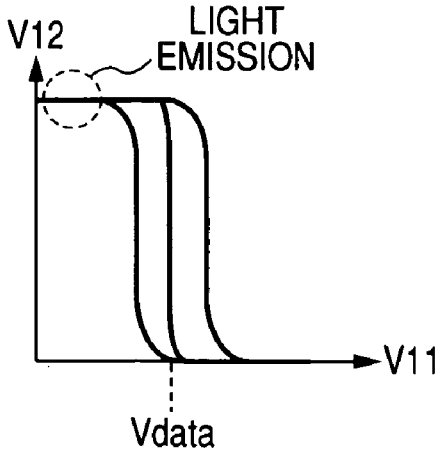
FIG. 26 is a graph showing the relation between the drain voltage of another OLED drive TFT and an image signal of the first example of the related art.
Figure 27:
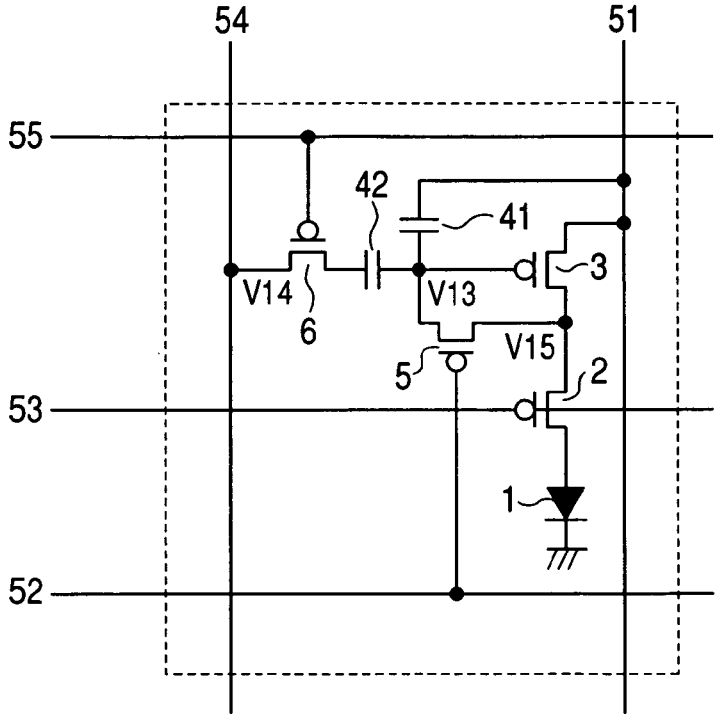
FIG. 27 is a pixel drive circuit of the second example of the related art.
Figure 28:
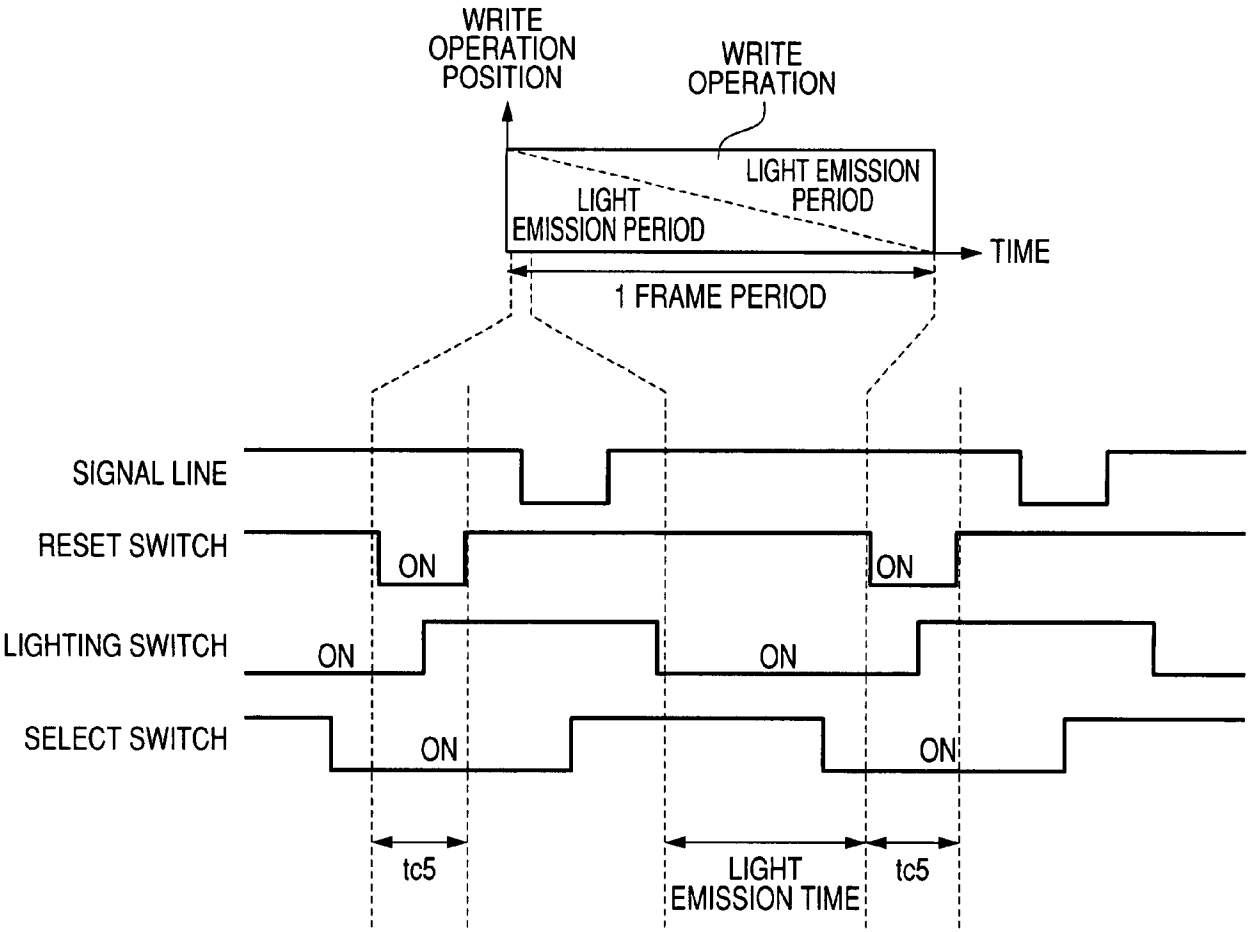
FIG. 28 is a timing chart of the second example of the related art.
Figure 29A:
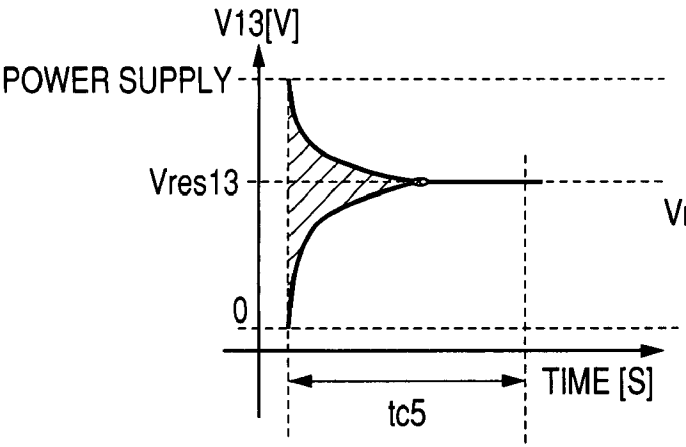
FIG. 29A is a graph showing transitions in the OLED drive TFT gate voltage of the second example of the related art.
Figure 29B:
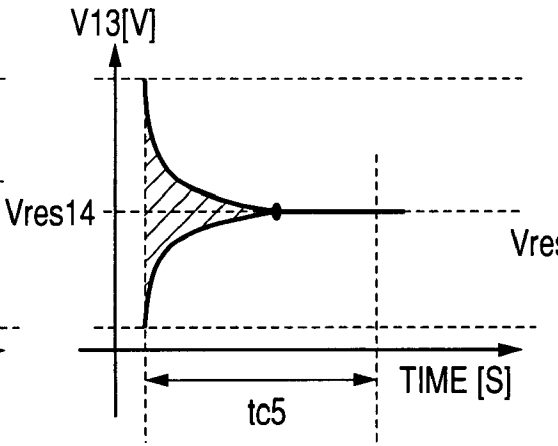
FIG. 29B is a graph showing transitions in the OLED drive TFT gate voltage of the second example of the related art.
Figure 29C:
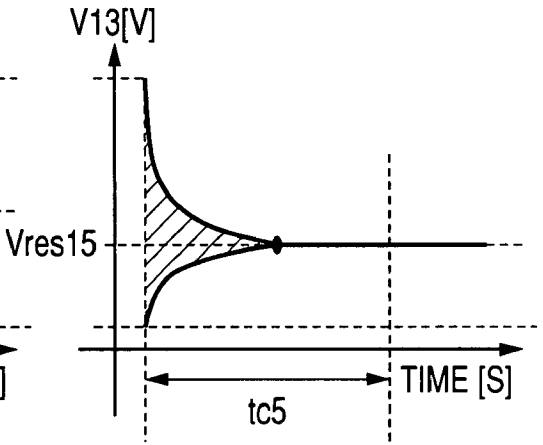
FIG. 29C is a graph showing transitions in the OLED drive TFT gate voltage of the second example of the related art.
Figure 30:
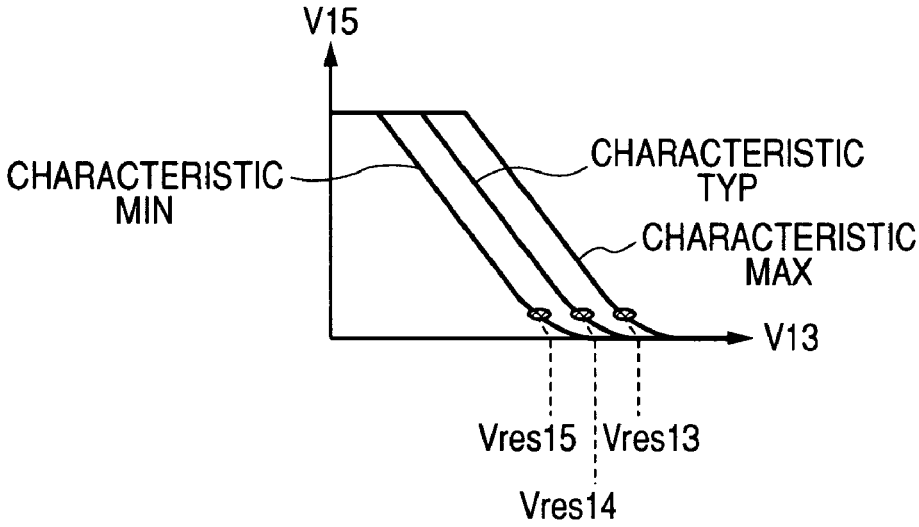
FIG. 30 is a graph showing the relation between the drain voltage and the gate voltage of an OLED drive TFT of the second example of the related art.
Figure 31:
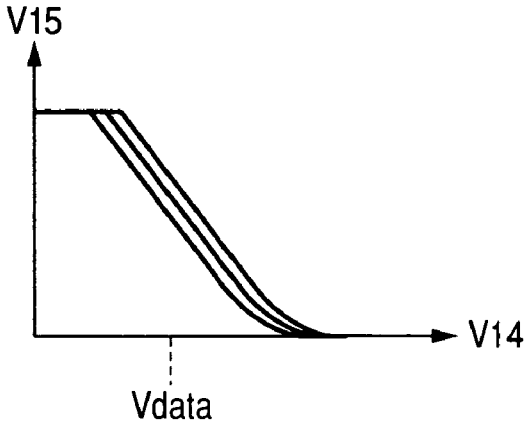
FIG. 31 is a graph showing the relation between the drain voltage of the OLED drive TFT and the image signal of the second example of the related art.
Figure 32A:
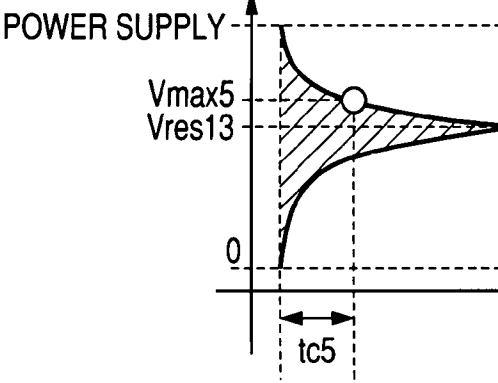
FIG. 32A is a graph showing transitions in the gate voltage of another OLED drive TFT of the second example of the related art.
Figure 32B:
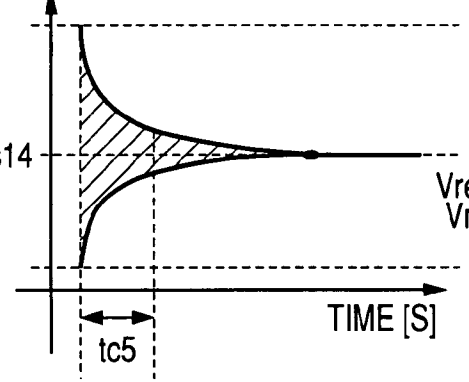
FIG. 32B is a graph showing transitions in the gate voltage of another OLED drive TFT of the second example of the related art.
Figure 32C:
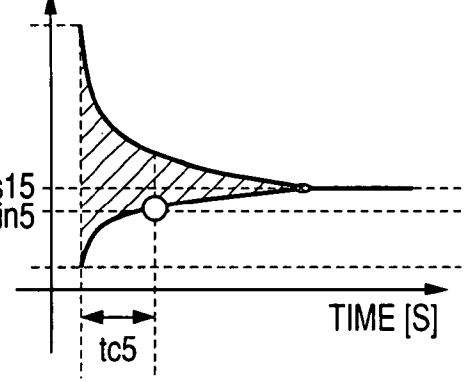
FIG. 32C is a graph showing transitions in the gate voltage of another OLED drive TFT of the second example of the related art.
Figure 33:
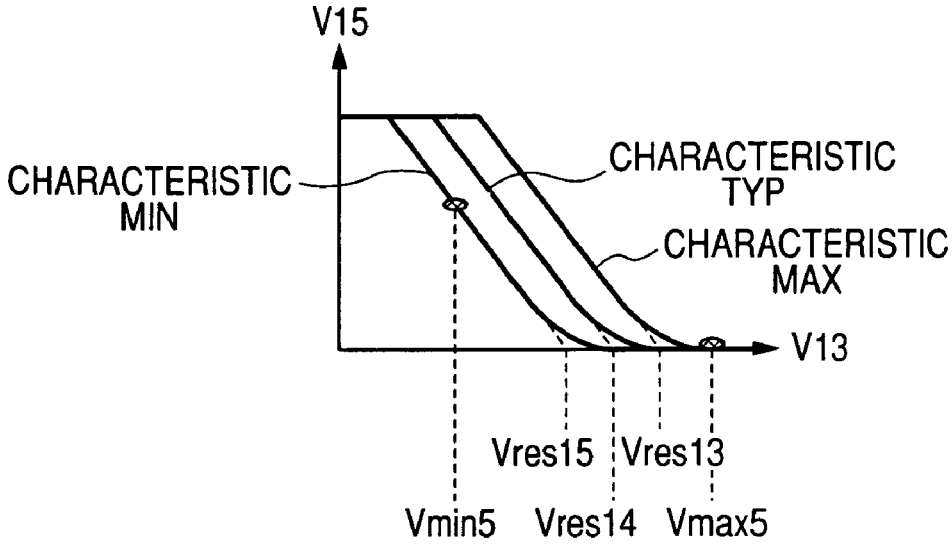
FIG. 33 is a graph showing the relation between the drain voltage and the gate voltage of another OLED drive TFT of the second example of the related art.
Figure 34:
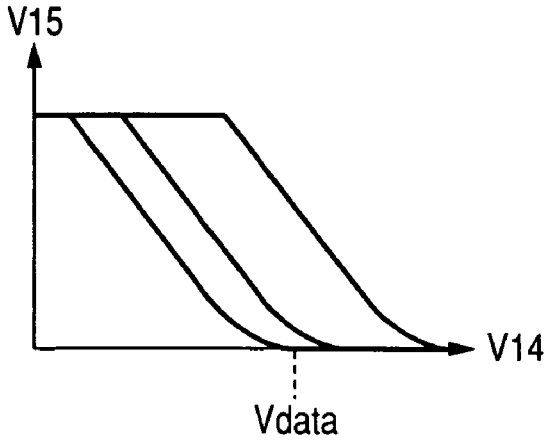
FIG. 34 is a graph showing the relation between the drain voltage of another OLED drive TFT and the image signal of the second example of the related art.

The above state is shown in FIG. 18. In FIG. 18, the vertical axis is the drain voltage V9 of the OLED drive TFT3 of FIG. 13, and the horizontal axis is the V8 serving as the signal voltage. The voltage V9 is approximately the same voltage as the voltage on the anode of OLED element 1 during the time the OLED element is lit (emitting light). The characteristic curves correspond to the characteristic MIN, the characteristic TYP, and the characteristic MAX in FIG. 17. As shown in FIG. 18, variations in V9 appearing in light emission characteristic versus the signal voltage V8 are reduced to a small value, even if there are variations in the OLED drive TFT3 characteristics.

Utilizing this invention therefore allows suppressing variations in light emission gray scale characteristics in the OLED element 1 versus data signals even in cases where the reset operation time is not long enough, and can provide uniform light emission without residual images even when displaying moving images.

Figure 35:
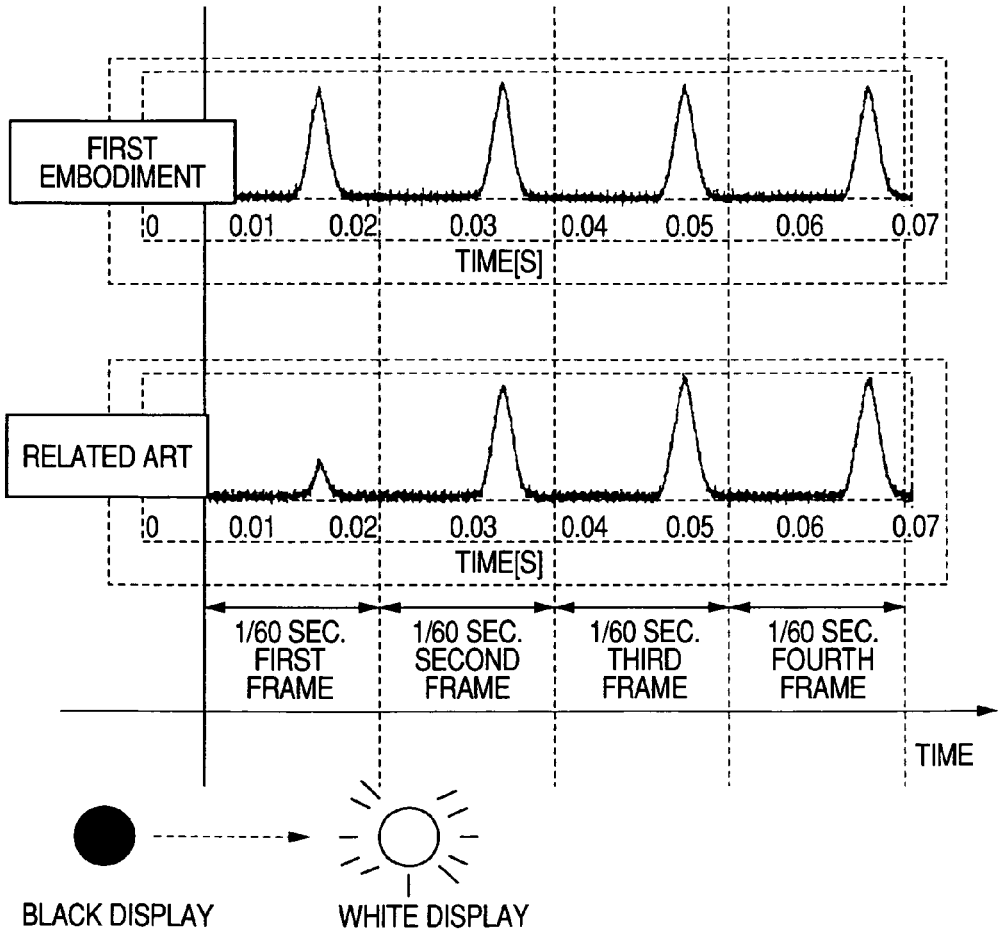
FIG. 35 is a graph comparing the first example of the related art and the first embodiment, and showing results of the first embodiment.

FIG. 35 shows results from comparing response in the first embodiment with the comparative examples of the related art when switching from a black display to a white display. In the example of the related art, a white display was reached over three frames after switching, but in the first embodiment a white display was reached in one frame. In other words, using the first embodiment allows emitting uniform light without residual images.

Low-temperature polysilicon was utilized in the first embodiment, or in the second embodiment and the third embodiment but amorphous silicon can be also be used. The screen in the first embodiment, or in the second embodiment and the third embodiment utilized a glass substrate as the substrate however the same effect can be rendered even with plastic or metal.

Figure 36B:
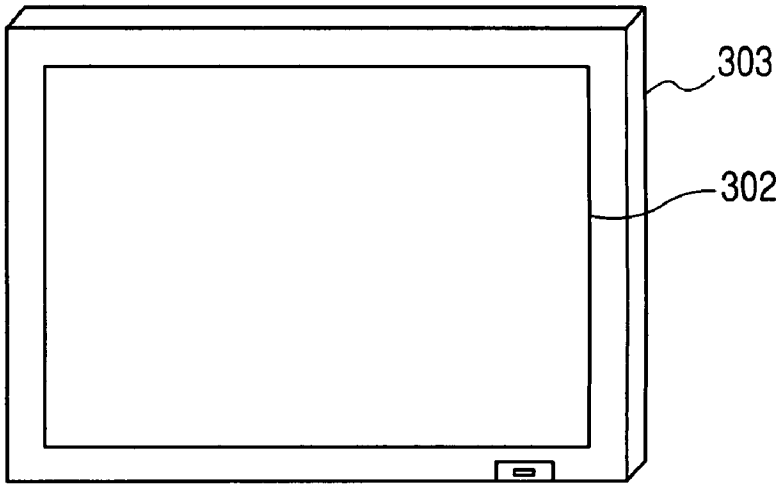
FIG. 36B is an example of another product utilizing this invention.
Figure 36A:
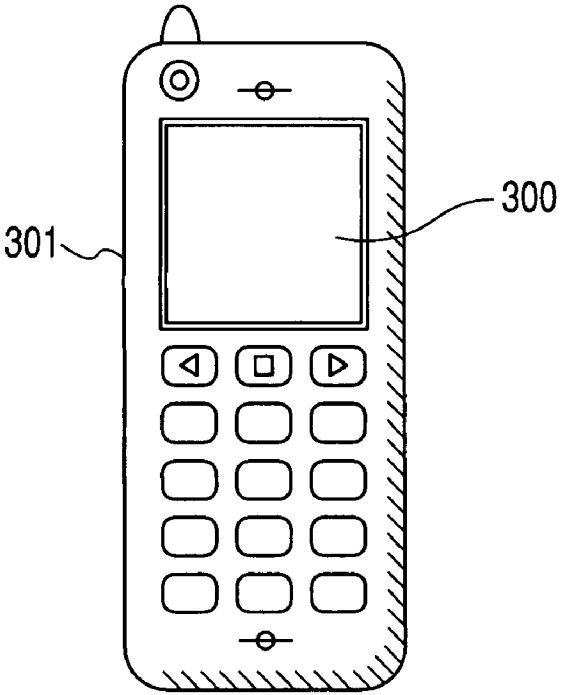
FIG. 36A is an example of a product utilizing this invention.

FIG. 36A shows an example that a highly uniform display without residual images and possessing lower power consumption can be achieved by utilizing the image display apparatus 300 of this invention in the image display unit of a mobile electronic device 301.

FIG. 36B shows an example that a highly uniform display without residual images and possessing lower power consumption can be achieved by utilizing the image display apparatus 302 of this invention in the image display unit of a television 303.

Figure 36D:
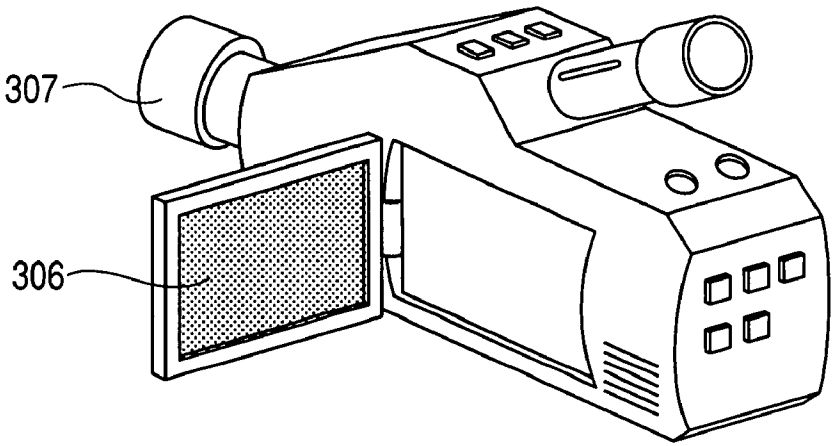
FIG. 36D is an example of yet another product utilizing this invention.
Figure 36C:
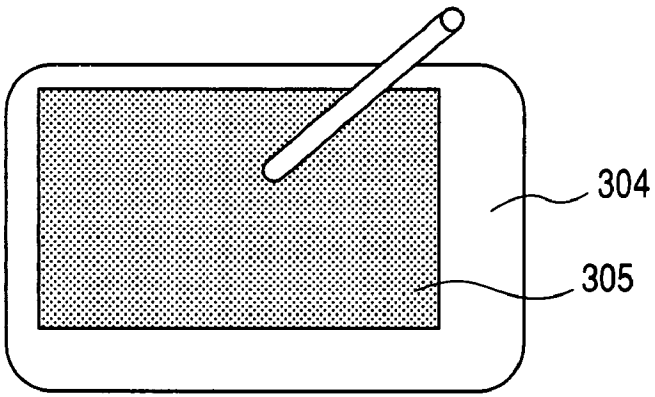
FIG. 36C is an example of still another product utilizing this invention.

FIG. 36C shows an example that a highly uniform display without residual images and possessing lower power consumption can be achieved by utilizing the image display apparatus 304 of this invention in the image display unit of a portable digital assistant terminal PDA 305.

FIG. 36D shows an example that a highly uniform display without residual images and possessing lower power consumption can be achieved by utilizing the image display apparatus 306 of this invention in the image display unit of a video camera CAM viewfinder 307.

What is claimed is:

1. An image display apparatus comprising:

a display unit formed from multiple pixels containing light-emitting elements;

signal lines for inputting image data signals to the pixel region; and a field effect transistor for driving the light-emitting elements based on image data signals inputted to the pixels via the signal lines, wherein a reference voltage is applied to the source electrode of the field effect transistor; a capacitor is connected to the gate electrode of the field effect transistor and a first switching unit is connected between the gate and drain electrodes of the field effect transistor to thereby connect the gate electrode to the drain electrode; and a second switching unit for applying a specified external voltage is connected to the drain electrode.

2. The image display apparatus according to claim 1, wherein the light emitting unit is an organic electroluminescent element (OLED: Organic Light Emitting Diode).

3. The image display apparatus according to claim 1, wherein the field effect transistor and the switching unit are formed on a transparent substrate utilizing a polycrystalline Si-TFT (Thin Film Transistor).

4. The image display apparatus according to claim 1, comprising a structure capable of resetting a capacitor connected to the gate electrode of the field effect transistor by applying a specified external voltage by turning on a second switching unit connected by a diode to the drain electrode of the field effect transistor by turning on a first switching unit.

5. An image display apparatus comprising:

a display unit formed from multiple pixels containing light-emitting elements;

signal lines for inputting image data signals to the pixel region; and a field effect transistor for driving the light-emitting elements based on image data signals inputted to the pixels via the signal lines, wherein a reference voltage is applied to the source electrode of the field effect transistor; a first switching unit is connected between the gate and drain electrodes of the field effect transistor, a second switching unit is connected to the gate electrode for applying a specified external voltage, and a capacitor is connected to the gate electrode.

6. The image display apparatus according to claim 5, wherein the light emitting unit is an organic electroluminescent element, (OLED: Organic Light Emitting Diode).

7. The image display apparatus according to claim 5, wherein the field effect transistor and the switching unit are formed on a transparent substrate utilizing a polycrystalline Si-TFT (Thin Film Transistor).

8. The image display apparatus according to claim 5, comprising a structure for resetting a capacitor connected to the gate electrode of the field effect transistor by applying a specified external voltage by turning on a second switching unit.

* * * * *